US005987272A

United States Patent [19]

Maeda et al.

[11] Patent Number: 5,987,272

[45] Date of Patent: Nov. 16, 1999

[54] IMAGE FORMING APPARATUS INCLUDING IMAGE QUALITY COMPENSATION MEANS

[75] Inventors: Yasutaka Maeda, Soraku-gun; Toshihiro Ohta, Ikoma-gun; Katsuhiro Nagayama, Yamabe-gun, all of Japan

[73] Assignee: Sharp Kabushiki Kaisha, Osaka, Japan

[21] Appl. No.: 09/010,293

[22] Filed: Jan. 21, 1998

[30] Foreign Application Priority Data

Jan. 30, 1997 [JP] Japan ..... 9-016098

[51] Int. Cl.[6] ..... G03G 15/00

[52] U.S. Cl. ..... 399/58; 44/59

[58] Field of Search ..... 399/58, 49, 56, 399/55, 53, 44, 59

[56] References Cited

U.S. PATENT DOCUMENTS 5,146,273 9/1992 Yamada ..... 399/44 X

FOREIGN PATENT DOCUMENTS 6-11935 1/1994 Japan .
6-282166 10/1994 Japan .
7-120992 5/1995 Japan .

*Primary Examiner*—Sandra Brase
*Assistant Examiner*—Quana Grainger
*Attorney, Agent, or Firm*—David G. Conlin; David A. Tucker

[57] ABSTRACT

A test patch image is formed and the density thereof is detected to maintain the image quality at a constant level. One of the image forming conditions, for example, the developing bias voltage of the developing unit inside the image forming apparatus that serves as a density controller, and is controlled in accordance with the detection result. Here, a humidity sensor for detecting the environmental change, that is, the humidity, is provided inside the apparatus, and the reference value of the toner mixing ratio is changed and corrected while the developing unit is operating when the humidity sensor detects a change in humidity. However, the toner mixing ratio is maintained and neither changed nor corrected when the density of the test patch image remains at the same level, so that the developing bias voltage is not corrected. Consequently, the correction of the toner mixing ratio is neither changed nor corrected in response to the change in humidity alone, thereby making it possible to maintain a stable image quality state.

10 Claims, 11 Drawing Sheets

IMAGE FORMING APPARATUS INCLUDING IMAGE QUALITY COMPENSATION MEANS

FIELD OF THE INVENTION

The present invention relates to an image forming apparatus, such as an electrophotographic copying machine (including a digital copying machine) and a printer, and particularly to an image forming apparatus for preventing image quality deterioration and realizing stable image quality compensation at all times.

BACKGROUND OF THE INVENTION

There have been proposed several methods to prevent image quality deterioration caused by changes over time or the like for image forming apparatuses, such as an electrophotographic copying machine and a laser printer, and these methods are already put into practice.

The image quality state of the image forming apparatus deteriorates gradually as the apparatus keeps forming images under the same conditions. The image quality deteriorates due to changes over time. More specifically, it occurs when initial image density can be no longer obtained as the charged state of a photosensitive body serving as a recording medium changes with an increase of the number of times of the image forming. Also, the image quality deteriorates when toner particles adhere to the background of the photosensitive body in a region where no toner particles are supposed to.

To eliminate such image quality deterioration in a simple manner, the following method has been proposed. That is, the number of times of the image forming by the image forming apparatus is counted, and a voltage supplied to charging means is controlled in accordance with the counted value, so that a charged potential of the photosensitive body is compensated to a predetermined state.

Also, the above method has been improved as follows. A charged potential of the photosensitive body is measured actually, and a voltage supplied to the charging means is controlled in accordance with the measuring result, so that the charged potential of the photosensitive body is maintained at a constant level to compensate the image quality. According to this improved method, since the charged potential of the photosensitive body can be maintained at a constant level in a secure manner, compensation accuracy is improved compared with the method to control the charged potential of the photosensitive body in accordance with the number of times of the image forming.

According to these methods, the charged potential of the photosensitive body is controlled to stay at a constant level at all times. However, controlling the charged potential of the photosensitive body alone is not enough, because an amount of friction-charge in the toner or the like varies with the environmental changes, such as changes in temperature and humidity, during the actual image forming process. Thus, even if the above methods are adopted, the toner density may differ from the initial density state or unwanted toner particles may adhere to a region in the background when a toner image is actually formed on the photosensitive body.

To solve the above problem, the following method has been proposed and put into practical use to further stabilize the image quality state. In this method, a test patch image (density detecting image) is formed directly on the photosensitive body, and the density of the test patch image is detected. Then, the detecting result and a predetermined reference density value are compared, and the image forming conditions are controlled in accordance with the comparison result, so that a test patch image having a reference image density will be formed. The image forming conditions referred herein are the charged potential of the photosensitive body applied by the charging means, an amount of light emitted from an exposing lamp, a developing bias from a developing device, and the like. The aforementioned unwanted adhesion of the toner particles to a region in the background can be prevented by controlling an amount of exposure, developing bias, etc.

As has been explained, the density of a toner image formed on the photosensitive body varies with not only the deterioration of the photosensitive body, but also the environmental changes, such as changes in temperature and humidity. However, since the above method can handle the environmental changes as well, it can realize more stable image quality compensation.

In case of a color image forming apparatus for forming a color image, when a toner image of each color formed on the photosensitive body is transferred onto a sheet, such as a normal paper serving as a transfer material, the toner image of each color must be superimposed sequentially one on another. Thus, the color image forming apparatus adopts a method using a transfer drum which winds the sheet around and transports the same to a transfer position. An intermediate transfer medium may be provided further, so that a toner image of each color formed on the photosensitive body is transferred thereon sequentially and superimposed one on another, after which the resulting image is transferred onto the sheet.

In the above color image forming apparatus, a testing toner patch image formed on the photosensitive body is transferred onto a transfer drum (including the intermediate transfer medium) touching the photosensitive body, and the density is detected by reading reflected light from the transferred toner patch image. As has been explained, a charging voltage supplied to the charging means is controlled in accordance with the density detection result and the density is adjusted to the reference density to compensate the image quality. According to this method, the density is detected after the toner image formed on the photosensitive body is actually transferred onto the sheet. Thus, it is obvious that better image compensation can be realized.

A method of such image quality compensation is disclosed in, for example, Japanese Laid-open Patent Application No. 11935/1994 (Tokukaihei 6- 11935). In an image forming apparatus disclosed therein, a toner image (test patch image) formed on the photosensitive body with a predetermined number of levels is transferred onto the transfer drum or the like, and the density of the transferred toner image is detected to judge whether the detected density is the reference density or not. A charge potential, a developing bias voltage or the like thereafter is modified in accordance with any difference between the detected density and the reference density so as to adjust the density of the toner image to substantially match the reference density.

Along with the image quality compensation, an image quality stabilizing control is carried out by a developing device which converts an image formed on the photosensitive body, that is, an electrostatic latent image, into a visual toner image. For example, a toner mixing ratio is controlled in addition to the aforementioned developing bias voltage control.

The developing device usually adopts a binary system developing method, and a mixing ratio (toner mixing rate or toner mixing ratio) of the toner and a carrier in a developing bath is maintained at a constant level, so that the toner density of a formed image remains the same. For this reason, the toner mixing ratio is detected by a magnetic permeability sensor and compared with a reference value, and the toner is replenished to the developing bath when the toner mixing ratio is judged to have dropped below the reference value. The density when developing a latent image formed on the photosensitive body is stabilized by controlling the mixing ratio of the toner and carrier in a developing agent to remain at the same level.

Consequently, it has become possible to realize the image quality compensation in response to the changes over time and the environmental changes concurrently by controlling the mixing ratio of the toner and carrier (developing agent) in the developing device to stay at the constant level while carrying out the above image quality stabilizing method at the same time.

On the other hand, Japanese Laid-open Patent Application No. 282166/1994 (Tokukaihei 6-282166) discloses a method for controlling a mixing ratio of the developing agent in the developing device in accordance with the detection result of the changes of the environmental state, particularly, the change in humidity. An image forming apparatus disclosed therein is furnished with means for detecting humidity, especially, absolute humidity. More specifically, the toner is replenished under the control of lowering a mixing ratio target value at normal temperature when the absolute humidity is high, and raising the same when the absolute humidity is low. Thus, the density when developing a latent image formed on the photosensitive body is controlled to remain at the same level in response to the change in humidity, thereby making it possible to stabilize the image quality.

According to the above Japanese Laid-open Patent Application No. 282166/1994 (Tokukaihei 6-282166), a conventional toner density detecting means detects the magnetic permeability of a layer of developing agent adhering to the carrier. Specifically, the quantity of toner particles that adhere to the carrier at any given time depends upon the amount of friction-charge acquired by the toner particles during toner mixing. Hence, the toner density in a layer of developer agent adhering to the carrier at any given point in time may be determined according to the inductance of a coil located near the developing agent layer. Thus, if a predetermined amount of friction-charge is not generated in the toner, an amount of the toner particles adhering to the magnetic carrier varies, which makes it impossible to detect a precise mixing ratio of the developing agent.

Such variance occurs when an amount of the friction-charge in the toner varies while the developing agent is mixed and stirred due to the changes of the environmental conditions, particularly, the change in humidity. In other words, when the humidity is high, an amount of the friction-charge decreases, whereas an amount of the friction-charge increases when the humidity is low, and this causes the aforementioned adverse effect.

To be more specific, in case that the density of the developing agent having a predetermined mixing ratio is detected, a detection signal voltage of the mixing ratio of the developing agent is large (indicating a decrease in an amount of toner) under a high temperature/high relative humidity circumstance (ambient environmental state). On the other hand, the detection signal voltage of the mixing ratio of the developing agent outputted under a high temperature/low relative humidity circumstance or a low temperature/high relative humidity circumstance is similar to the one outputted under a normal temperature/normal relative humidity (indicating a predetermined amount of toner) circumstance. Also, an amount of charge in the toner decreases under a high temperature/high relative humidity circumstance, and more toner particles readily adhere to an electrostatic latent image. Thus, under the above circumstance, if the toner is replenished in a direct response to the detection signal of the mixing ratio of the developing agent, too many toner particles adhere to the electrostatic latent image during the developing process. Therefore, a toner replenish correction control for controlling an amount of replenished toner based on the detection result of humidity or the like is necessary.

In contrast, under the low temperature/high relative humidity and high temperature/low relative humidity circumstances, the detection signal voltage of the mixing ratio of the developing agent is similar to the one outputted under the normal temperature/normal humidity circumstance. Thus, if the toner replenish correction control is carried out based on the above idea with the relative humidity detection signal, the high temperature/high relative humidity circumstance and low temperature/high relative humidity circumstance can not be distinguished from each other, thereby making the corrected state an error. Hence, if the toner replenish correction control is carried out by merely referring to the relative humidity detection signal, the correction control is carried out erroneously under some environmental conditions, and the image density is affected adversely.

As has been explained, since an amount of the charge in the toner varies with humidity, when the magnetic permeability sensor is used as a detector of a mixing ratio of the toner and carrier in the developing bath, an output value from the magnetic permeability sensor varies while the mixing ratio remains the same, thereby causing an incorrect toner mixing ratio control.

To solve the above phenomenon, in case of a method, in which a humidity sensor is provided inside the image forming apparatus and a mixing ratio of the developing agent is corrected to the reference value in accordance with an output from the humidity sensor under the control, the absolute humidity is detected and the mixing ratio of the developing agent is controlled based on the detection result in above-mentioned Japanese Laid-open Patent Application No. 282166/1994 (Tokukaihei 6-282166). In other words, if the relative humidity is used, an erroneous correction may be carried out when the magnetic permeability varies with the environmental changes, which makes the correction unsatisfactory.

However, in case of detecting the absolute humidity, there is another problem of a cost increase, because a temperature sensor is necessary in addition to the humidity sensor. In other words, the sensors for detecting the absolute humidity are very expensive.

On the other hand, in the control device disclosed in above Japanese Laid-open Patent Application No. 11935/1994 (Tokukaihei 6-11935), when the developing bias voltage is varied, for example, a correction response is very quick. However, if a mixing ratio of the developing agent made of the toner and carrier is equal to or smaller than a predetermined value, a desired image density can not be obtained no matter how well the developing bias voltage is controlled.

Thus, another possible correction control is to change a toner mixing ratio of the developing agent along with the control of the developing bias voltage. However, this is not an optimal method, because the responsivity is slowed down if the toner mixing ratio of the developing agent alone is corrected. Moreover, the image density varies considerably with the change of the mixing ratio. Further, in case of above Japanese Laid-open Patent Application No. 282166/1994 (Tokukaihei 6-282166), not only the image density varies with the change in humidity, but also the aforementioned mixing ratio problem occurs. Thus, controlling the mixing ratio based on the relative humidity can make the image quality unstable, thereby making the image quality stabilizing control very difficult.

The reason why the responsivity is slowed down when the mixing ratio of the developing agent is controlled is because it takes a considerable time until the mixing ratio stabilizes since the toner is replenished and mixed with stirring.

On the other hand, in the image quality compensating method disclosed in above Japanese Laid-open Patent Application No. 11935/1994 (Tokukaihei 6-11935), the test patch image is formed merely in accordance with the predetermined levels. However, an amount of reflected light differs significantly depending on the colors of the test patch images, for example, color toner and black toner. Thus, forming exactly the same test patch image for each color is not enough to carry out the correction control in a satisfactory manner.

SUMMARY OF THE INVENTION

It is therefore a first object of the present invention to provide an image forming apparatus which can eliminate the above problems, and particularly, to provide an image forming apparatus which compensates the image quality and density in a stable manner by controlling a mixing ratio of a developing agent made of toner and a carrier adequately when at least one of the image forming conditions, such as a developing bias voltage, is controlled in accordance with a test patch image.

Also, it is a second object of the present invention to provide an image forming apparatus for forming a test patch image and carrying out image quality compensation using the test patch image, and more specifically, for carrying out highly accurate image quality compensation by stabilizing the detection state of the test patch image regardless of its color.

To fulfill the first object, an image forming apparatus of the present invention is an image forming apparatus for reproducing an image by forming a latent image of the image on a recording medium, converting the latent image into a developed image with a developing agent including toner to visualize the latent image, and transferring the developed image onto a sheet, and is furnished with:

an image quality compensating section for, apart from an image forming operation for reproducing the image, forming a test patch image at a predetermined density on the recording medium to detect a density thereof, and subsequently for controlling at least one of image forming conditions based on a detection result to form an image while maintaining an image quality state of the image at a constant level;

an environment detecting sensor for detecting an operating environment inside the image forming apparatus; and a toner mixing ratio correcting section for, when the image quality compensating section detects the density of the test patch image, determining whether a toner mixing ratio of the developing agent should be changed or not in response to an environment detection state from the environment detecting sensor.

According to the above arrangement, a humidity sensor for detecting relative humidity is provided as the environment detecting sensor. Thus, when the image compensating section controls the developing bias voltage in accordance with the detected density of the test patch image, the toner mixing ratio correcting section changes the toner mixing ratio based on both the correction state of the developing bias voltage and the detection state of the humidity sensor. Consequently, unlike a conventional image forming apparatus, the toner mixing ratio is not changed under control based on the detection state of the humidity sensor alone, and an image having a normal density can be formed at all times, thereby making stable image quality compensation possible. In addition, the mixing ratio can be controlled in accordance with the image density only by providing the relative humidity sensor, which enables stable image quality compensation to be realized.

To fulfill the second object, an image forming apparatus of the present invention is an image forming apparatus for reproducing an image by forming a latent image of the image on a recording medium, converting the latent image into a developed image with a developing agent including toner to visualize the latent image, and transferring the developed image onto a sheet, and furnished with:

an image quality compensating section for, apart from an image forming operation for reproducing the image, forming a test patch image having a predetermined density on the recording medium to detect a density thereof, and subsequently for controlling at least one of image forming conditions based on a detection result to form an image while maintaining an image quality state of the image at a constant level, wherein, the image quality compensating section detects the density in accordance with a first amount of reflected light from the test patch image and uses the first amount to control one of the image forming conditions, and when the first amount of reflected light can not be detected, the image quality compensating section forms the test patch image on a reflection area with a good reflection condition to detect a second amount of reflected light from the reflection area and uses the second amount to control one of the image forming conditions, and the image quality compensating section controls a unit area amount of toner particles adhering to the test patch image formed on the reflection area becomes small, so that the second amount of the reflected light from the reflection area and the first amount of reflected light from the test patch image of any other color are equal.

According to the above arrangement, the image quality compensating section forms test patch images of different patterns for the colors being used, for example, so that it can detect the density of the test patch image of each color precisely. Also, the density of the test patch image of each color can be detected accurately by changing the transfer conditions when the test patch image of each color is transferred onto the transfer medium or the like. Since the test patch image can be transferred under the same conditions as those for transferring an actual image onto a sheet, the density detection can be carried out under the same condition as those for forming an actual image on a sheet. Consequently, highly accurate image quality compensation can be realized.

For a fuller understanding of the nature and advantages of the invention, reference should be made to the ensuing detailed description taken in conjunction with the accompanying drawings.

DESCRIPTION OF THE EMBODIMENTS

Figure 1:
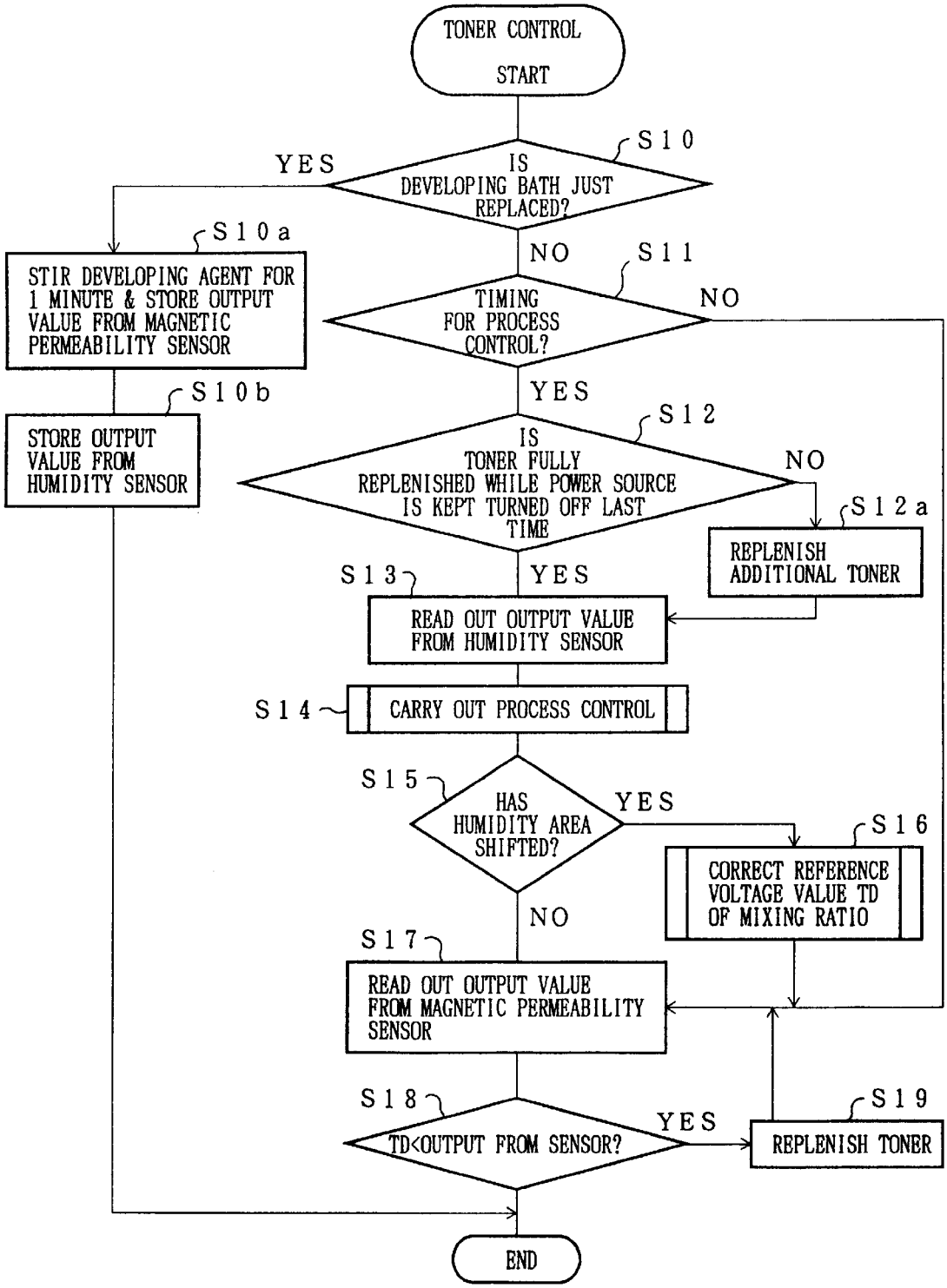
FIG. 1 is a flowchart detailing a control procedure for carrying out image quality compensation in an image forming apparatus in accordance with the present embodiment.

An example embodiment of the present invention will be explained in the following.

FIGS. 1 through 5 are flowcharts detailing a control procedure for image quality compensation. FIG. 6 is a view schematically showing an arrangement of an image forming apparatus of the present embodiment, more specifically, an electrophotographic color printer.

To begin with, the image forming apparatus will be explained with reference to FIG. 6. In the present embodiment, a color printer is used as an example image forming apparatus. However, the present invention is not limited to the above example, and can be also applied to all kinds of the electrophotographic image forming apparatus.

(Arrangement of Image Forming Apparatus)

As shown in FIG. 6, the image forming apparatus main body drives a drum photosensitive body 1 (recording medium) to rotate in a direction indicated by an arrow A. The photosensitive body 1 is charged uniformly to a particular polarity by a charger 2, and exposed by a laser beam emitted from a laser scanning unit 3, whereby an electrostatic latent image of an original image is formed. Four developing units 4*a* through 4*d* serving as developing devices are sequentially placed at an exposure position of the laser beam at the downstream side with respect to the rotation to enable the development in four colors: yellow, cyan, magenta, and black. The development is carried out by selectively driving one of the four developing units 4*a* through 4*d* each time the photosensitive body 1 is exposed.

Each toner image formed on the photosensitive body 1 by the developing units 4*a* through 4*d* is transferred onto a sheet of a normal paper or the like withheld by a transfer drum 5 (transfer medium) which is driven to rotate at the same circumferential speed as that of the photosensitive body 1. In other words, the transfer drum 5 is driven to rotate in a direction indicated by an arrow B in FIG. 6 by a motor also driving the photosensitive body 1. The transfer drum 5 is arranged in such a manner that an arbitrary voltage is applied by a CPU 6, a D/A convertor 7*c*, and a high voltage circuit 8*c* serving as a transfer voltage power source.

Figure 7:
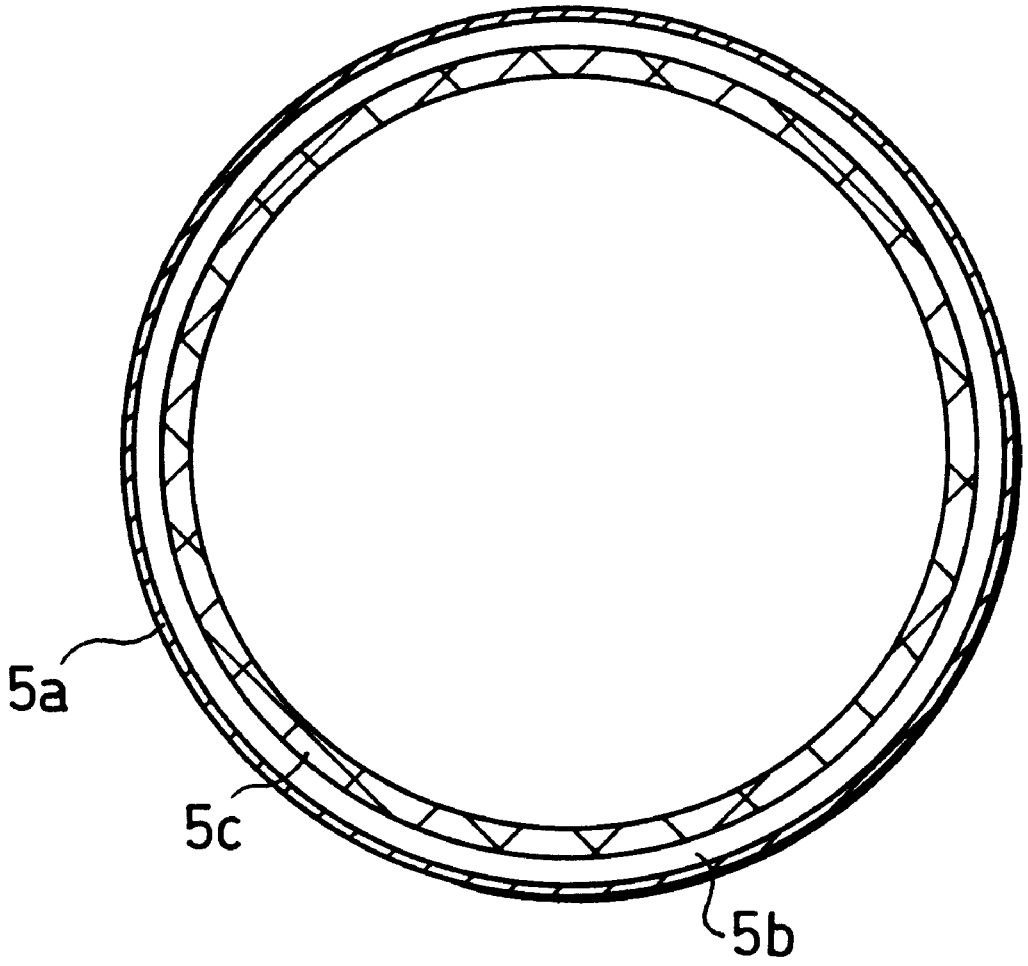
FIG. 7 is a cross section showing an example transfer drum used in the above image forming apparatus.

An arrangement of the transfer drum 5 is detailed in FIG. 7. As shown in the drawing, the transfer drum 5 has a triple-layer structure. That is, the surface of the transfer drum 5 is covered with a high resistance layer 5*a* made of PVDF (polyvinylidene difluoride) of about 75 μm thick, underneath of which a semiconductor layer 5*b* made of hydrin rubber of about 5 mm thick is formed, and a conductive base material 5*c* of about 5 mm thick made of an aluminum cylinder or the like is formed as the bottom layer.

Thus, when a predetermined voltage is applied to the base material 5*c* of the transfer drum 5, a sheet is electrostatically attracted to the surface layer 5*a* of the transfer drum 5. In other words, a sheet fed from a sheet feeding cassette 9 is winded around the transfer drum 5 by a roller 10. At this point, the sheet is electrostatically attracted to the surface of the transfer drum 5 as previously mentioned, and transported further to a position to oppose the toner image formed on the photosensitive body 1.

The toner image formed on the photosensitive body 1 is transferred onto the sheet on the transfer drum 5 at the contacting point of the photosensitive body 1 and transfer drum 5. At this point, the predetermined voltage is applied to the base material 5*c* of the transfer drum 5 as previously mentioned, so that the toner image on the photosensitive body 1 is transferred onto the sheet on the surface of the transfer drum 5. When the transfer ends, the toner particles which were not transferred and remain on the surface of the photosensitive body 1 are removed by a photosensitive body cleaner 11, while unwanted charges on the surface of the photosensitive body 1 are removed by an erasing lamp 12. Then, the image forming process in another color, or another color image forming operation can be started.

When the above image forming apparatus starts the image forming operation, the photosensitive body 1 is charged uniformly by the charger 2, and an image is written thereon by a laser beam emitted from the laser scanning unit 3 based on image data from an unillustrated image processing device or the like. In other words, a semiconductor laser 15 is switched ON/OFF by the CPU 6 in accordance with the image data, and a light beam is scanned through the laser scanning unit 3 along the axis of rotation of the photosensitive body 1, whereby a light image is written on the photosensitive body 1. In this case, since an image portion (a portion to which the toner particles adhere) is written by the laser beam, a potential of the image on the photosensitive body 1 is reduced to almost 0.

The image data referred herein mean a unicolor signal obtained by separating a full color image into each color. In this case, since four colors are used, an image is written on the photosensitive body 1 based on the black image data first, sequentially followed by yellow, magenta, and cyan image data, for example.

Then, the electrostatic latent image formed on the photosensitive body 1 is developed at the developing position of each of the developing units 4*a* through 4*d*. Here, each of the developing units 4*a* through 4*d* closes its unillustrated shutter provided somewhere between its opening and the photosensitive body 1, so that the developing agent withheld therein is not transported on the surface of the magnet roller while the image data of any other color is developed. Alternatively, a shutter made of an elastic member is pressed against the surface of each developing roller forming the developing unit, so that unwanted developing agents are controlled not to be transported. A predetermined developing bias voltage (V1) is applied to each of the developing units 4*a* through 4*d* from the power source of the developing bias voltage, that is, a high voltage circuit 8*b*, through a D/A convertor 7*b* under the control of the CPU 6. The toner particles adhere to the electrostatic latent image formed on the photosensitive body 1 by the above voltage.

The toner image formed in the above manner rotates to a transfer position, where the photosensitive drum 1 and transfer drum 5 contact with each other, in sync with the sheet electrostatically winded around the transfer drum 5, and transferred onto the sheet electrostatically by a transfer voltage applied to the transfer drum 5.

If there remain any other image data to be transferred, the sheet having thereon transferred the toner image of a particular color is transported to the transfer position again as the transfer drum 5 rotates, so that a toner image of another color formed next on the photosensitive body 1 is superimposed thereon. Consequently, the toner image of each color formed on the photosensitive body 1 is transferred and superimposed sequentially on the sheet.

On the other hand, when the toner image has been transferred onto the sheet on the transfer drum 5, the toner particles remaining on the photosensitive body 1 are removed by the cleaner 11, and the charges remaining on the photosensitive body 1 are removed by the erasing lamp 12. Then, as has been explained, the image forming apparatus starts an image forming step of another color.

As the above steps are repeated, the toner images of four colors are superimposed on the sheet, and the sheet is separated from the transfer drum 5 by a separating claw 13 and introduced into a fusing unit 14. The toner image is heat-fused on the sheet introduced into the fusing unit 14, after which the sheet is released to a releasing tray 17.

(Image Quality Compensation Control)

The following description will describe the image quality compensation control by the above image forming apparatus for adjusting the density of an image formed on the sheet to a predetermined reference density under control.

Normally, the image forming apparatus automatically forms a test patch image during the step before the image forming operation, for example, while the image forming apparatus is rising up or in a suspended state, and carries out the control of at least one image forming (processing) condition in accordance with the density of the test patch image. The image forming conditions referred herein mean, as has been explained, the charged potential of the photosensitive body 1 applied by the charger 2, the developing bias for the developing units 4*a* through 4*d*, etc.

Thus, the image forming apparatus of the present embodiment forms a test patch image on the photosensitive body 1 at a predetermined density, that is, under a predetermined condition, and transfers the same on the transfer drum 5 to detect the density thereof. Then, the image forming apparatus sets the condition for the above process control based on the detected density to form an image having the reference density on the photosensitive body 1. Consequently, the image forming condition is adjusted automatically, so that a stable density, that is, a stable image quality state, can be obtained under any circumstance.

Thus, when the test patch image is formed, the toner image (test patch image) is transferred onto the transfer drum 5, and the characteristics changes of the toner density (adhesive density of the toner particles) of the test patch image is detected. In this case, unlike the image forming operation, no sheet is winded around the transfer drum 5, and the test patch image formed on the photosensitive body 1 is directly transferred onto the surface of the transfer drum 5.

A toner density sensor 16, composed of a light emitting section 16*a* and a light receiving section 16*b*, is provided at an opposing position to the transfer drum 5 to measure the density of the test patch image. A density signal detected by the toner density sensor 16 is taken into the CPU 6 through an A/D convertor 18*a*. The CPU 6 compares the input detected density and the predetermined reference density, and sends a control signal to a high voltage circuit 8*a* and to the high voltage circuit 8*b* through the D/A convertor 7*b* in accordance with the comparison result. Consequently, the high voltage circuit 8*a* controls a voltage supplied to the charger 2. Also, the high voltage circuit 8*b* controls the developing bias voltage supplied to the developing roller of each of the developing units 4*a* through 4*d*.

The CPU 6 drives the light emitting section 16*a* under its control through the D/A convertor 7*a* to carry out the above density detection by means of the toner density sensor 16 at the same timing as the test patch image forming timing.

In the above arrangement, the surface of the photosensitive body 1 is charged uniformly by the charger 2 to form the test patch image thereon. In the present embodiment, three test patch images of different densities are formed. Since the image forming apparatus of the present embodiment is a color printer, three test patch images are formed for each color of the developing units 4*a* through 4*d*. Here, three developing bias voltages at different levels are set for the three test patch images, respectively, so that each test patch image has different density.

Figure 8:
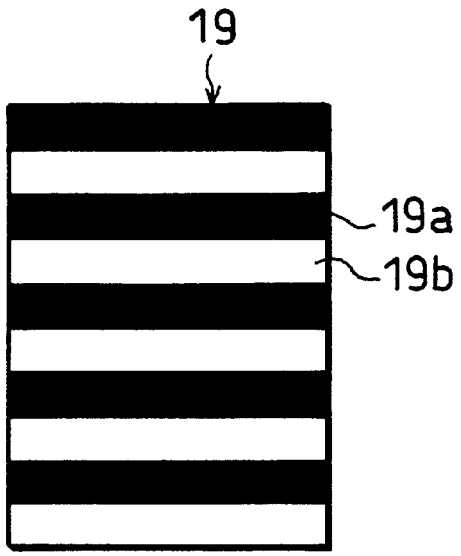
FIGS. 8 (*a*) and 8 (*b*) are views explaining example test patch images formed on the transfer drum.
Figure 8:
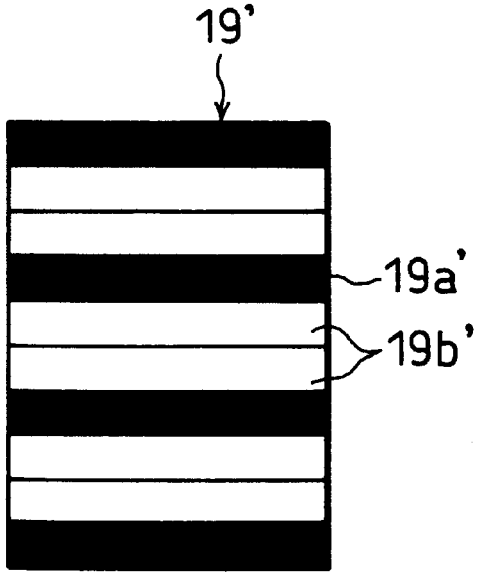

After the surface of the photosensitive body 1 is charged uniformly, a laser beam is irradiated to the photosensitive body 1 from the laser scanning unit 3, and a test patch image is written thereon. An example test patch image 19 is shown in FIG. 8(*a*), in which portions 19*a* to which the toner particles adhere and portions 19*b* to which the toner particles do not adhere are formed alternately in the ratio of 1:1 on the uniformly charged surface of the photosensitive body 1. Here, the laser beam is irradiated to the portions 19*a* to which the toner particles adhere.

The test patch image 19 of FIG. 8(*a*) is used as a test patch image for the color toners, that is, yellow, magenta and cyan toners. On the other hand, a test patch image for the black toner is a test patch image 19' shown in FIG. 8(*b*). This is because the toner density sensor 16 is a reflective type sensor which detects an amount of reflected light from the toner. In other words, since an image of the black toner absorbs the irradiated light, the toner density sensor 16 detects the reflected light from the background on which the test patch image is formed. Thus, the higher the density, the smaller the amount of the reflected light. Contrarily, in case of a color toner image, the higher the density, the larger the amount of the reflected light. Thus, the toner density sensor 16 has opposite detecting results in cases of the black toner and color toners.

Moreover, the transfer drum 5 explained in the present embodiment has the transparent surface layer 5*a* and almost black semiconductor layer 5*b*. Therefore, in case of a black toner image, light emitted from the light emitting section 16*a* of the toner density sensor 16 is absorbed completely, and no amount of reflected light can be detected. For this reason, a silk print in white is applied to the inner surface of the surface layer 5*a* as a transfer area on which the black test patch image 19' is formed. The test patch 19' is formed on a white area of the silk printed area, that is, a high reflection area 20 (See FIG. 10).

Further, as has been explained, in case of the test patch image 19', an amount of reflected light from the background portion to which the toner particles adhere is detected.

Therefore, if the same image is written by the laser beam in both the color toner and black toner cases, a detection output as to the amount of reflected light is not the same. This is the reason why areas 19*a*' to which the toner particles adhere are wider than areas 19*b*' to which the toner particles do not adhere in the test patch 19' as shown in FIG. 8(*b*) unlike the test patch image 19 for the color toner. In the present embodiment, the test patch 19' is formed in such a manner that a ratio of the areas 19*a*' and 19*b*' is 1:2.

Consequently, the sensitivity in both the color toner case and black toner case can be adjusted to the same level, and the toner density sensor 16 can detect the density of the black toner at a satisfactory sensitivity. Thus, the change of density can be detected in a satisfactory manner even in case of the black toner, thereby making a stable image quality control possible.

The test patch 19 for the color toners and the test patch 19' for the black toner are converted into visual images by the developing units 4*a* through 4*d* with different developing bias voltages. The visualized test patch images 19 and 19' are transferred onto the transfer drum 5 by a transferring section. In this case, as has been explained, the transfer timing of the test patch image 19' for the black toner image is controlled so as to be transferred onto the silk printed high reflection area 20.

In the present embodiment, the test patch image is directly transferred onto the transfer drum 5, and the transfer bias at this point is set to a transfer voltage lower than a transfer voltage when an image is transferred onto a sheet winded around the transfer drum 5 in the normal image forming operation. In other words, when the test patch image is directly transferred onto the transfer drum 5, a normal transfer voltage is too strong, because a space is very small compared with the transfer through a sheet, and the toner transfer characteristics are different when the test patch image is transferred through the charge polarization onto the rear surface of the sheet and when the test patch image is transferred directly onto the transfer drum 5. If an image is transferred on the normal transfer voltage, re-transfer or image disturbance occurs at the separation (when the transfer drum 5 is separated from the photosensitive drum 1) because an electric field is too strong.

Therefore, to carry out the transfer adequately, the transfer voltage when an image is transferred onto a sheet is set to, for example, 2.0–0.8 kV, whereas when the test patch image is transferred, the transfer voltage is set to 0.8 kV or below. Consequently, the test patch image can be directly transferred onto the transfer drum 5 in the same manner when an image is transferred onto a sheet. Hence, the transfer efficiency thus obtained is substantially the same as the one obtained when an image is transferred onto a sheet.

Further, in the present embodiment, an amount of charge in the color toners and an amount of charge in the black color are slightly different. To be more specific, in case of the black toner, specific resistance is lower because of carbon contained therein, and an amount of charge decreases accordingly. Thus, different values are set as the transfer voltage when forming the test patch image for the color toners and when forming the test patch image for the black toner. For example, when the test patch image for the color toners is formed, an optimal transfer voltage is in a range between 0.8 kV and 0.5 kV. On the other hand, when the test patch for the black toner is formed, an optimal transfer voltage is in a range between 0.6 kV and 0.3 kV.

As has been explained, when the test patch image of each color is formed on the transfer drum 5, the density of the same is detected by the toner density sensor 16. The detection result is sent to the CPU 6, which carries out the following control. That is, since the processing is carried out in such a manner that the test patch 19 or 19' is outputted with satisfactory density, the accuracy of the image quality compensation carried out later is improved. Moreover, since the transfer voltage is controlled to be at different levels when an image is formed or depending on the colors or the like, the test patch is transferred onto the transfer drum 5 normally in the same manner when an image is transferred onto a sheet, thereby making highly accurate image quality compensation possible.

The transfer property of the test patch image depends on a resistance value of the transfer drum 5. Thus, it is impossible to control all the apparatuses to adjust the densities detected by their respective toner density sensors 16 to the same reference value. Thus, when each image forming apparatus is assembled, the test patch image is formed under the same condition, and transferred to a transfer drum position used in a process control (image quality compensation control) to correct the reference value.

In other words, since the test patch image is formed under the same condition, the output from the toner density sensor 16 based on each test patch image should be the same. However, if there is a spot having a higher resistance value on the transfer drum 5, the density of the test patch image formed on that particular spot differs, that is, drops, from the density of the rest portions.

Thus, the resistance value of each spot on the circumference of the transfer drum 5 is measured in advance. An example measuring method of the resistance value will be explained in the following. That is, the test patch images are formed on all the circumference of the transfer drum 5 under the same developing condition, and the resistance value at each spot on the circumference is estimated by detecting an amount of reflected light from the test patch images thus formed. As a result, the data related to the resistance value of the transfer drum 5 are obtained in advance, and if the resistance value of the portion on which the test patch image is actually formed is relatively high compared with an average resistance value on the circumference, the detected value is corrected, so that higher density is detected on the test patch image formed on the above portion. This correction is necessary when most of the resistance values on the transfer drum are high.

In this case, the detected density value of the test patch image does not have to be corrected, because the test patch image is formed on the transfer drum 5 with a density raised in advance in accordance with the resistance value of the transfer drum 5. According to this method, it is no longer necessary to correct the detected density value of the test patch image. Thus, if the user knows in advance that the transfer state of the transfer drum 5 is different, the correction can be done in the above-described manner, thereby making both the more precise density detection and the more accurate image quality compensation possible.

As has been explained, the process control is carried out after the toner density, that is, the density of the test patch image formed in the above manner, is detected. In the present embodiment, an example case where the developing bias voltage is controlled by the above process control will be explained.

Figure 11:
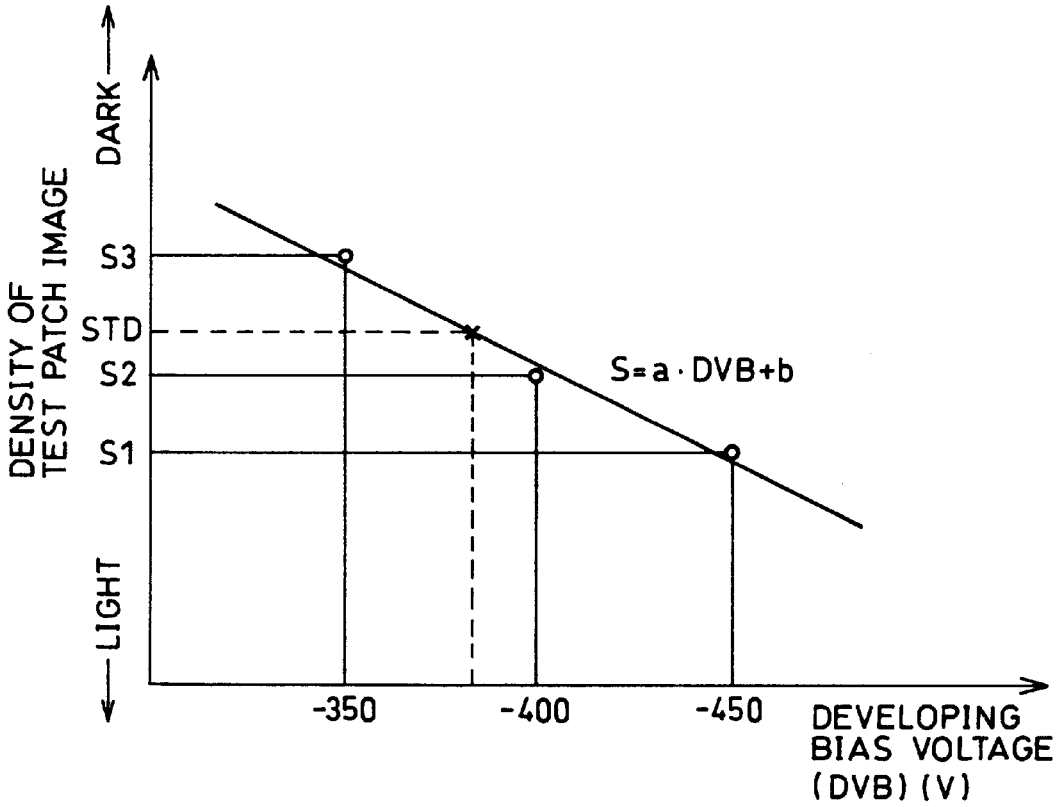
FIG. 11 is a graph showing a correlation between a detected density of the test patch image and a developing bias voltage during the image quality compensation.

In the control method of the developing bias voltage, as shown in FIG. 11, the density of the test patch image detected by the toner density sensor 16, and a value of the developing bias voltage on which the image is formed are plotted on a graph through linear approximation. A developing bias voltage on which the reference value (STD) is outputted as an actual output value from the toner density sensor 16 is computed using the above graph.

To be more specific, in case that three test patch images 19 for yellow are formed, the developing bias voltages DVB of the developing unit 4*a* are set to −350 Vm −400 V, and −450 V to develop the three test patch images, respectively. After the test patch images 19 shown in FIG. 8(*a*) are formed through exposure by the laser scanning unit 3, on the developing bias voltages DVB, the surface of the photosensitive body 1 is developed. The test patch images developed by the yellow toner at this point are transferred onto the transfer drum 5 under the applying condition for each of the voltages. When each test patch image reaches a position opposing the toner density sensor 16, the density thereof is detected.

Let S1, S2, and S3(S1<S2<S3) be the density values detected by the toner density sensor 16 with the test patch images developed on their respective developing bias voltages and transferred onto the transfer drum 5. Here, since there is a difference among the detected densities S1 through S3 of the test patch images formed on their respective developing bias voltages, the densities S1 through S3 are plotted on a graph through the linear approximation (see FIG. 11) by S=a·DBV+b.

Thus, coefficients a and b can be found by the approximation based on the density detected values and the developing bias voltages at three points on the basis of the following equation:

$$S1=a\cdot DVB1+b(DVB1=-450V)$$

$$S2=a\cdot DVB2+b(DVB2=-400V)$$

$$S3=a\cdot DVB3+b(DVB3=-350V).$$

In the above approximation, a known method, such as the least square, can be used to find the coefficients a and b. Let STD be the reference density value, then a developing bias V1 corresponding to STD can be found from an equation: STD=a·V1+b. In other words, V1 can be readily found as: V1=(STD−b)/a.

In the above example, the test patch image is formed by the color toner (yellow toner). Thus, the higher the output value from the toner density sensor 16, the higher the density of the formed image. On the contrary, in case of the test patch image for the black toner, the higher the output value from the toner density sensor 16, the lower (lighter) the image density. This happens because the amount of the reflected light from a white background portion of the transfer drum 5 is detected.

In this manner, the developing bias voltage V1 is found in accordance with the density detection with the test patch image of each color. The developing bias voltage V1 thus found is stored into a storage section and used for the following image forming operation.

Here, if there is a considerable difference in the developing bias voltage with respect to the surface potential of the photosensitive body 1, there occurs a phenomenon that the carrier adheres to the surface of the photosensitive body 1, or fogging on the background due to the potential difference. In other words, the toner particles adhere to an area on the photosensitive body 1 where no image is formed.

For this reason, the developing bias voltage has limit values for the control. For example, let Vs be the developing bias voltage on which the reference density can be obtained at the initial stage, then the limits of the correction voltage are set to ±100V from Vs. If a correction voltage exceeding the above limit is applied, the above phenomenon occurs. To solve this problem, in the image forming apparatus of the present embodiment, the correction voltage is controlled not to exceed the above limits.

In particular, when the developing bias voltage DBV is set using the test patch image, the developing bias voltages DBV1 and DBV3 are set within a range of ±50V from the developing bias voltage DBV2, which corresponds to the reference density. Consequently, the test patch image can be formed in an accurate manner while minimizing the unwanted carrier adhesion or fogging.

If it turns out that a correction developing bias value exceeding the upper or lower limit is necessary for at least one of yellow, magenta, cyan, and black as the result of the toner density detection with the test patch image, that particular color is corrected to the limit, and as for the other colors, the reference values are adjusted in accordance with an amount of correction for that particular color. Consequently, the image density for yellow, magenta, cyan, and black can be adjusted separately while the priority is placed on the color balance.

More specifically, in case of the above example, the reference value of the developing bias voltage supplied to the developing unit 4*a* for yellow is −400V, and the upper and lower limits of an amount of correction are ±50V therefrom (−450V and −350V), respectively. If 100V (−500V or −300V) is computed as a necessary amount of correction, a correction of 50V, which is the upper (lower) limit of the amount of correction for yellow, is carried out. This means the correction is carried out with an amount 50% lower than the original target value. Thus, if a necessary amount of correction for cyan is computed as 80V when the upper and lower limits of the amount of correction for cyan is ±100V, a correction of 80V is possible. However, since an amount of the correction for yellow is 50% of the original, a correction with 50% of the computed value with respect to the reference value, that is ±40V, is also carried out for cyan. The same is applied for the magenta toner and black toner.

As has been explained, according to the present embodiment, the test patch images shown in FIGS. 8(*a*) and 8 (*b*) of each color are formed before the image forming operation, and the density of each test patch image is detected by the toner density sensor 16 after they are transferred onto the transfer drum 5. Then, the developing bias voltage V1 on which the reference image density STD can be obtained is found in accordance with the detection result. Since the following image forming process is carried out based on the developing bias voltage V1 thus found, the stable image forming with a constant predetermined image density, that is, the image forming with constant image quality, can be realized. Since the image density can be detected accurately in response to both the changes of the photosensitive body 1 or the like over time and the environmental changes, the stable image quality can be realized.

(Example Image Quality Compensation Control)

In the following, an image quality compensation control in response to the environmental changes will be explained. In particular, described in the present example is the above compensation control method for further compensating the image quality to stay at a constant level at all times by controlling a mixing ratio of the toner and carrier of the developing agent in the developing unit to be an optimal ratio in response to the humidity inside the image forming apparatus.

In the image forming apparatus in accordance with the present example, a humidity sensor is provided at a position where it can monitor the environmental changes of the image forming apparatus. For example, as shown in FIG. 6, a humidity sensor 21 (environment detecting sensor) is placed near a position where a sheet is transported to the transfer drum 5.

The humidity sensor 21 is a sensor for detecting relative humidity, and a detection output therefrom varies with a humidity state. For example, the humidity sensor 21 is a sensor having a simple arrangement such that outputs a larger voltage as the humidity rises, and outputs a smaller voltage as the humidity drops. The humidity sensor 21 is placed above the sheet feeding cassette 9, for example, and a detected voltage, namely, the output therefrom, is inputted into the CPU 6 serving as control means through an A/D convertor 18*b*.

Figure 9:
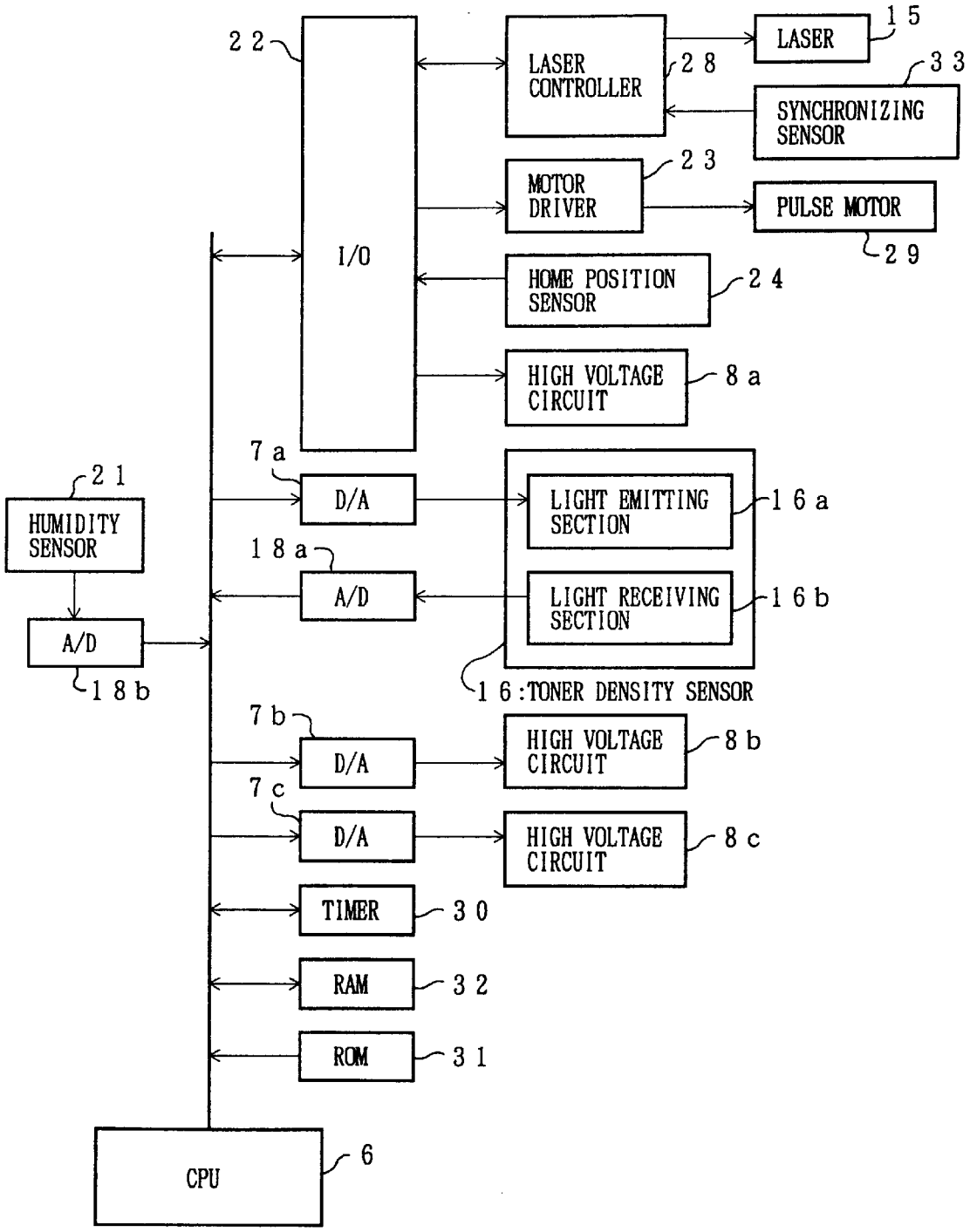
FIG. 9 is a block diagram depicting an arrangement of a control circuit of the image forming apparatus of FIG. 6.

FIG. 9 is a block diagram schematically showing the arrangements of the CPU 6 and peripheral circuits or the like placed under the control of the CPU 6. The arrangement of these control circuits will be explained with reference to FIG. 9.

The CPU 6 is connected to a subject control section through I/O port 22. In other words, the I/O port 22 is connected to the laser 15 and a synchronizing sensor 33 of a polygonal mirror placed in the laser scanning unit 3 through a laser control block 28. The I/O port 22 is also connected to a driving pulse motor 29 for the photosensitive body 1 and transfer drum 5 through a motor driver 23. Further, the I/O port 22 is connected to the high voltage circuit 8 for the charger 2, and a transfer drum home position detecting sensor 24.

Figure 10:
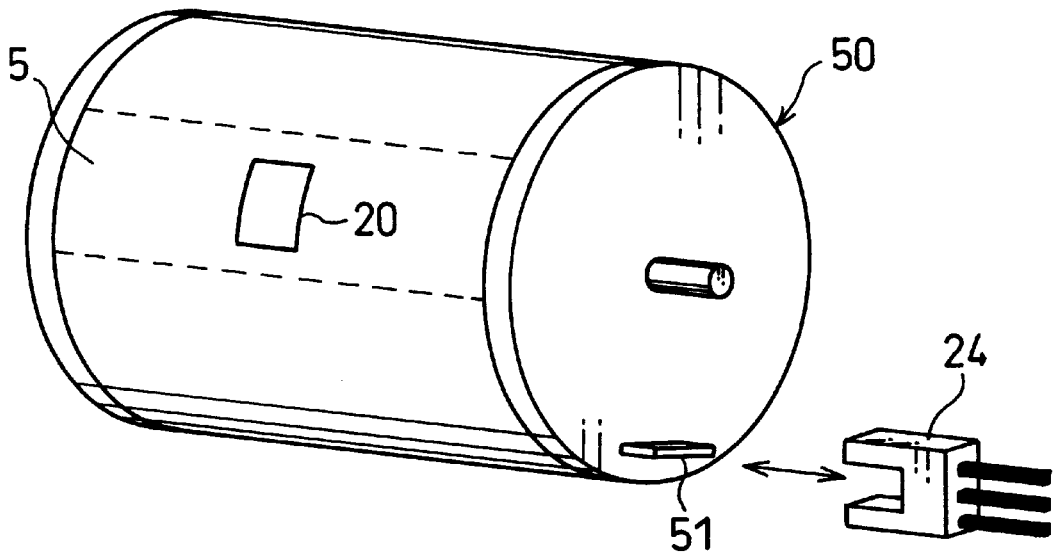
FIG. 10 is a perspective view showing an example to detect a home position on the transfer drum.

The transfer drum home position detecting sensor 24 is provided to transfer the test patch image 19' or the like to a predetermined position on the transfer drum 5 by detecting a home position on the transfer drum 5. Also, the transfer drum home position detecting sensor 24 obtains the timing for a sheet winding and a sheet separation. The home position on the transfer drum 5 is detected by detecting a protruding detection piece 51 provided in a flange portion 50 which holds the drum 5 rotatable as shown in FIG. 10 by a photosensor (home position sensor) 24. Also, as shown in FIG. 10, the reflection area (white portion) 20 is formed on the transfer drum 5 through the silk printing or the like, so that the test patch image 19' for the black toner is transferred thereon.

As shown in FIG. 9, an amount of light from the light emitting section 16*a* of the toner density sensor 16, an output from the high voltage circuit 8 for the developing bias voltage, and an output from the high voltage circuit 8*c* for the transfer voltage are separately controlled through the 8-bit D/A convertors 7*a*, 7*b*, and 7*c*, respectively. Also, a density detection output of the light receiving section 16*b* of the toner density sensor 16 is connected to the 8-bit A/D convertor 18*a*, and a detection output of the humidity sensor 21 is connected to the 8-bit A/D convertor 18*b*, so that the CPU 6 reads an amount of received light (density) and humidity.

A timer 30 is arranged to interrupt the operation of the CPU 6 at regular time intervals, so that the CPU 6 can readily detect a rotational position of the transfer drum 5 based on a time since a detection signal is outputted from the transfer drum home position detecting sensor 24. Consequently, the timing for sheet attraction or separation, the timing for the test patch image transfer and the like can be controlled.

A ROM 31 stores control programs or control parameters of various kinds for controlling the image forming apparatus and forming the test patch images, parameters used for correcting a detected value from the toner density sensor 16, etc. A RAM 32 is used as a work area for running the programs or the like.

(Explanation of Image Quality Compensation Control Operation)

Referring to FIGS. 1 through 5, the following description will describe an image quality compensation control operation of the present example. To begin with, a control procedure of the present example will be explained briefly.

In the first place, an initial toner density level is stored into the image forming apparatus. Thus, the image forming apparatus confirms an exchange state of the developing units 4*a* through 4*d*. This confirmation is done to set the initial reference density in each developing unit, so that the following control is carried out based on the above reference density.

Further, if any of the developing units are replaced, the toner mixing ratio of toner and carrier particles in the developer agent in the new developing unit is detected and stored in place of the initial reference value (TD) of the prior developing unit. A humidity value inside the image forming apparatus at the detection of the mixing ratio is also stored. In short, a detection value from the humidity sensor 21 is stored. The reference value TD and humidity value are stored into the RAM 32 and saved even after the power source is turned OFF.

When the reference value TD is detected in the above humidity state, the developing agent in the developing unit is stirred in a satisfactory manner for a certain period, for example, one minute, and the detection result by a known magnetic permeability sensor is stored as the reference value TD. The toner mixing ratio is controlled to always stay at the reference value TD during the image forming operation based on the detection value of the magnetic permeability sensor.

A range of an output value from the humidity sensor 21 is divided into some areas in advance, and the area to which the output value belongs is stored. An example of classifying the detection result by the humidity sensor 21 into the divided areas is set forth in Table 1 below.

TABLE 1

| HUMIDITY SENSOR OUTPUT VALUE | HUMIDITY AREA | |
|---|---|---|
| 0.73–1.5V | AREA 4 | HIGH HUMIDITY |
| 0.43–0.72V | AREA 3 | |
| 0.2–0.42V | AREA 2 | |
| 0.05–0.19V | AREA 1 | LOW HUMIDITY |

In other words, in the present example, a range of the output value from the humidity sensor 21 is divided into four areas, and the CPU 6 stores the Areas 1 through 4 into the RAM 32 depending on the humidity state. The number of the areas can be set arbitrary. The output value may not be divided into areas, and can be stored directly into the RAM 32.

As has been explained, the mixing ratio of the developing agent in each of the developing units 4*a* through 4*d* is detected, and the detected ratios are stored as the reference values TD, after which the normal mixing ratio control is carried out.

In other words, when images are formed using the developing units, the mixing ratio of the developing agent, namely, a ratio of the toner, drops as the toner is consumed. Thus, the mixing ratio of the developing agent in each developing unit is detected during the image forming operation. In response to the detection result, the reference value TD and the detected value from the magnetic permeability sensor are compared. When the latter is larger than the former, the toner is replenished and the detection by the magnetic permeability sensor and the comparison with the reference value are carried out again. Repeating the above detection and comparison makes it possible to control the mixing ratio of the developing agent in each developing unit to stay at the predetermined reference value. Consequently, it has become possible to maintain the density of the formed image at a constant level, and hence, stabilize the image quality.

On the other hand, the image forming apparatus of the present example carries out an image quality compensation operation to maintain the density of an actually formed image at a constant level in addition to the image forming operation. During the image quality compensation operation, the test patch or the like is formed, and the test patch image is formed at the density detecting timing, whereby at least one of the image forming conditions is controlled, and at the same time the control as to whether the toner mixing ratio in each of the developing units 4*a* through 4*d* should be changed or not is carried out. In other words, the detection result of the toner mixing ratios varies with the change in humidity. If the toner mixing ratio is simply controlled to stay at the reference value TD, the output varies even when the actual toner mixing ratio stays at the same level, thereby causing inconveniences, such as insufficient toner, and making the stable image quality compensation impossible.

In other words, since the humidity sensor 21 detects relative humidity as the humidity value, the sensor 21 detects high humidity under a low temperature/high humidity circumstance. However, the actual magnetic permeability of the developing agent has hardly risen. If the mixing ratio reference value is corrected under such a circumstance, the toner mixing ratio is corrected erroneously as a result of the above control.

To solve this problem, in the present example, the current environments, that is, the currently detected humidity area is compared with one of the humidity areas set forth in Table 1 above and used when determining (setting) the reference value, and in which direction the area has been shifted is confirmed. Whether the toner mixing ratio changing control should be carried out or not is determined based on the above confirming result and the result of the image compensation control (process control) from the test patch image forming process.

To be more specific, under the low temperature/high humidity circumstance, since the humidity sensor 21 detects the high humidity, the toner mixing ratio is normally corrected to drop. However, in the process control, the image density does not rise substantially, and the developing bias voltage value does not move in an increasing direction. Thus, in the present example, the developing bias voltage value, which is one of the image forming conditions, is not increased in the process control, so that the mixing ratio is not corrected. Consequently, it has become possible to prevent inadequate rise of the toner mixing ratio.

On the contrary, under the high temperature/low humidity circumstance, since the humidity sensor 21 detects the low humidity, the toner mixing ratio is normally corrected to drop. However, in the process control, the image density does not drop substantially, and the developing bias voltage value does not move in a decreasing direction. Thus, like in the above case, the developing bias voltage value is not increased by the process control, so that the mixing ratio reference value is not corrected. Consequently, it has become possible to prevent an exceeding drop of the toner mixing ratio.

As has been explained, in the present example, correlating the image density correcting operation and the operation of the humidity sensor 21 can realize the toner mixing ratio control and the image forming density correction with fewer problems when an image is actually formed.

Further, in the pre-step of the process control, or in the step of forming the test patch image for the process control, the mixing ratio control is carried out adequately using the test patch image detection result based on the current mixing ratio. Therefore, the control of the toner mixing ratio is not carried out while the test patch image is formed.

The process control can be carried out under the conditions set forth below:

(1) immediately after the power source of the image forming apparatus is turned ON, especially, when the fusing temperature is 100° C. or below;

(2) when the humidity area changes based on the detection by the humidity sensor 21;

(3) a pre-rotation for the following image forming operation to be carried out after a predetermined period since the process control ended; and (4) when the process unit (developing units, developing agent, photosensitive body, etc.) of the printer is replaced.

The predetermined period referred in the condition (3) above may be changed with an amount of correction of the developing bias voltage used in the preceding process control.

In particular, when an amount of correction of the developing bias voltage was large (the developing bias voltage was corrected significantly with respect to the reference value) in the preceding process control, the processing conditions may have been changed considerably for some reasons, and the changed factors may possibly return to the initial state over time. Thus, the process control is carried out at the timing set forth in Table 2 below.

TABLE 2

| DEVELOPING BIAS CORRECTION AMOUNT | TIME (MIN.) | NUMBER OF SHEETS |
|---|---|---|
| 100V OR GREATER | 10 | 20 |
| 99-50V | 60 | 120 |
| 50-0V | 180 | 400 |

As shown in Table 2 above, the process control is carried out at the point either the time or sheet number condition is met.

Figure 2:
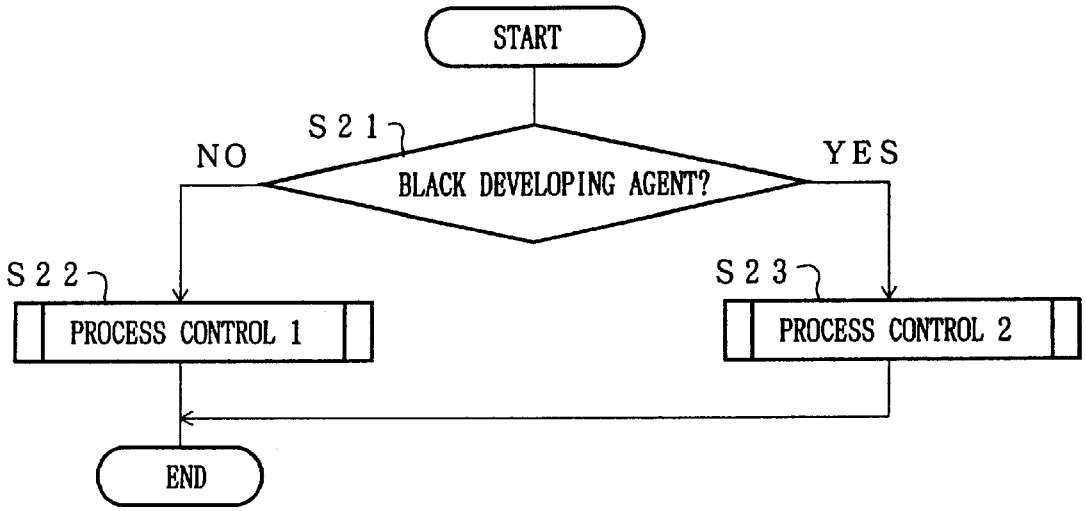
FIG. 2 is a flowchart detailing a judging procedure for discriminating between a compensation control using a color toner and a compensation control using a black toner in the above image quality compensation control.
Figure 3:
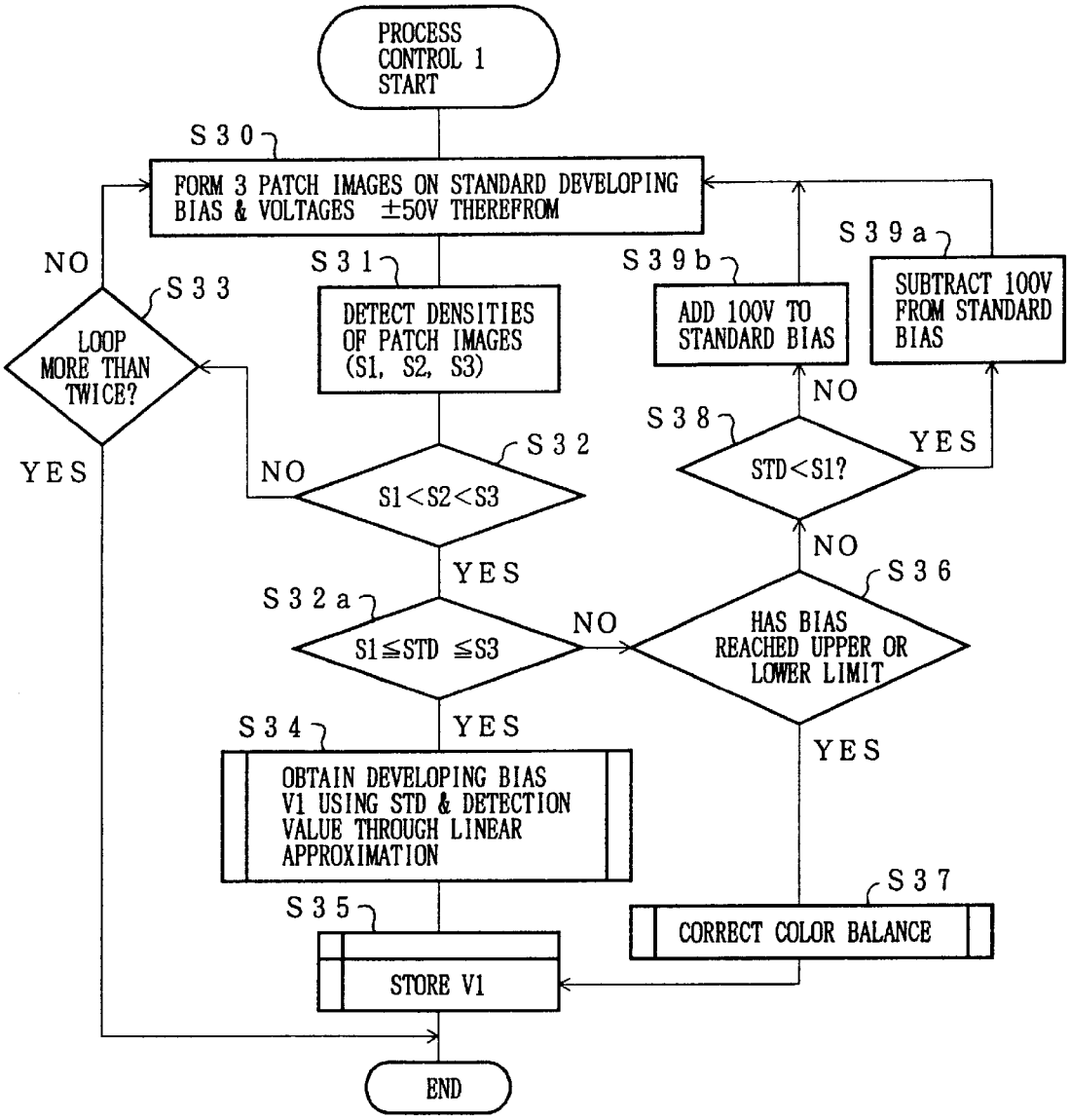
FIG. 3 is a flowchart detailing the compensation control using the color toner in the above image quality compensation control.
Figure 4:
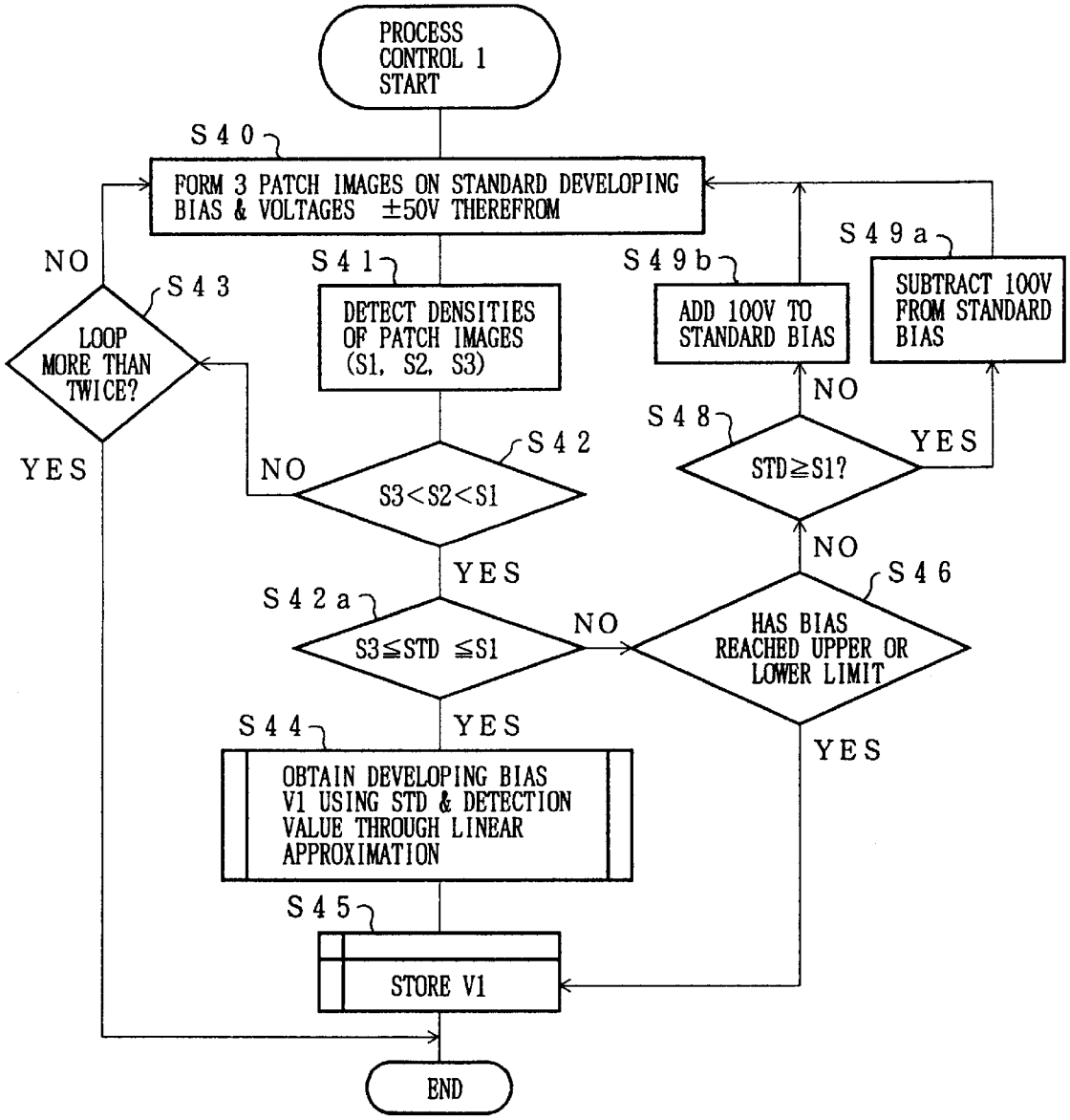
FIG. 4 is a flowchart detailing the compensation control using the black toner in the above image quality compensation control.

The control operation by the process control is detailed in FIGS. 3 and 4. The above-described image quality compensation control will be explained with reference to FIGS. 1 through 5.

(Control Procedure of Toner Mixing Ratio)

In the flowchart in FIG. 1, whether any of the developing units 4*a* through 4*d* is just replaced or not is judged in S10. This judgment includes the replacement of the developing agent or the like. In other words, when the developing agent is replaced, the developing unit is removed, and the old developing agent is replaced with a new developing agent. That is, the deteriorated developing agent is removed and a new developing agent is replenished. At this point, a switch or the like is set to indicate the replacement of the developing agent. The image forming apparatus detects the setting state of the switch or the like with the developing units being set into their original positions, and recognizes the replacement of the developing agent. The switch or the like is reset upon the recognition. If any of the developing units is detached or attached for a purpose other than the developing agent replacement, the image forming apparatus can not detect the replacement state of the developing agent.

If the developing agent or any of the developing unit is just replaced, the developing agent in the developing bath is stirred for, for example, 1 minute, in a satisfactorily manner, and the mixing ratio of the developing agent, namely, the toner mixing ratio, is detected by the magnetic permeability sensor after the carrier and toner are mixed with each other in a satisfactory manner and the toner mixing ratio is stabilized. Accordingly, an output value is stored (S10*a*). This value is set as the reference value TD of the toner mixing ratio in the image forming operation later. The humidity at this point is detected by the humidity sensor 21, and the detected value is also stored (S10*b*). This humidity value is stored as the initial humidity value.

As has been explained, after the processing immediately following the replacement of the developing agent or any developing unit ends, or it is confirmed that any developing unit or the like has not been replaced in S10, whether it is the timing for the process control or not is judged (S11). Here, whether any of the aforementioned conditions (1) through (4) is met or not is judged. In case the condition (3) is met, the judgment is made based on either the time or number of sheets set forth in Table 2 above. In other words, the judgment is made based on the condition (3) depending on the amount of correction of the developing bias voltage in the preceding process control, an elapsed time since the preceding process control until now, and the number of sheets having thereon formed images.

If it is judged to be the timing for the process control, whether the toner has been replenished while the power source of the image forming apparatus was kept turned OFF last time is judged (S12). This is done to additionally replenish the toner if the replenishment has not been completed because the power source was turned OFF during the toner replenishing operation or some other reasons (S12*a*). When the replenishment ends, or if the toner was not replenished while the power source of the image forming apparatus was kept turned OFF, an output value from the humidity sensor 21 is read out (S13). Subsequently, the process control is carried out (S14), which will be detailed below with reference to FIGS. 2 through 4.

After the process control ends, and a new developing bias voltage value V1, which is one of the image forming conditions, is determined, whether the current output value from the humidity sensor 21 is shifted from the humidity area set forth in Table 1 above and used when setting the toner mixing ratio reference value TD is judged (S15). If the humidity area is shifted, the flow proceeds to a routine to correct the reference value (output voltage value from the magnetic permeability sensor) TD of the toner mixing ratio (S16), the detail of which is set forth in FIG. 5.

As has been explained, if the humidity value read out in S13 is the same as the humidity value read out in the initial state (S10*b*), or the correction control (S16) for the toner mixing ratio of the developing agent is carried out in response to a change of the humidity value, the toner mixing ratio is detected by the magnetic permeability sensor (S17). The detected result and the reference value TD of the toner mixing ratio are compared (S18), and if the former is greater than the latter, the toner is judged as being insufficient and replenished accordingly (S19). Subsequently, the toner mixing ratio is detected by the magnetic permeability sensor again, and S17–S19 are repeated, whereby the current toner mixing ratio is adjusted to the reference value TD under control.

The toner mixing ratio of the developing agent is adjusted to the predetermined reference value TD under control by the toner replenishment in S17–S19. However, this is a known control and when the process control is not necessary in S11, that is, during the image forming operation or the like, the flow skips to S17 and the toner mixing ratio control is carried out.

In the present example, if the current humidity area is judged to have been shifted from the humidity area used when the reference value of the toner mixing ratio is set (for example, S10*a*→S10*b*), the correction control of the toner mixing ratio is carried out in S16. It should be noted that whether the correction control of the mixing ratio should be carried out or not is determined based on not only the judging result in S15, but also the result of the process control in S14, which will be described below.

For example, when the developing bias voltage V1 is corrected in an increasing direction, if the detected humidity from the humidity sensor 21 is in a lower humidity area than the humidity area used when setting the preceding toner mixing ratio, the correction control of the toner mixing ratio is carried out. However, when the detected humidity is in a higher humidity area, the correction control of the toner mixing ratio is not carried out.

In other words, the correction control of the toner mixing ratio is carried out if the humidity area is shifted in an increasing direction when the developing bias voltage is corrected in an increasing direction, or the humidity area is shifted in a decreasing direction when the developing bias voltage is corrected in a decreasing direction.

In the other cases, the correction control of the toner mixing ratio is not carried out. In these cases, an image can be formed normally while the image quality is kept at a constant level by correcting the developing bias voltage alone.

(Image Quality Compensation Control Procedure by Image Quality Compensating Means)

Next, the procedure of the process control for carrying out the image quality compensation will be explained. In the present example, the CPU 6 operates as image quality compensating means. When the process control is carried out in S14 in FIG. 1, as shown in the flowchart of FIG. 2, which kind of the process control should be carried out for which developing unit is judged (S21). In case of the color developing units 4*a* through 4*c*, a routine (control flow of FIG. 3) of the process control 1 is carried out (S22), and in case of the black toner developing unit 4*d*, a routine (control flow of FIG. 4) of the process control 2 is carried out (S23).

Note that the process control is carried out for each of the four colors: yellow, magenta, cyan, and black. Thus, in case of the color toner, as shown in FIG. 3, the developing bias voltages are set to the standard developing bias voltage (for example, −400v) and the voltages +50V therefrom (−450V and −350V). Then, as has been explained, the latent images of the test patch images of FIG. 8 (*a*) are formed and developed (S30) The developed test patch images are transferred onto the transfer drum 5, and the density of each is detected by the toner density sensor 16 (S31). Whether the detected densities of the three kinds of test patch images, S1, S2, and S3 (S1 is the density on −450V, S2 is the density on −400V, and S3 is the density on −350V) satisfy the relation, S1<S2<S3, or not is judged (S32).

If S1, S2, and S3 do not satisfy the above relation, the test patch images are formed again under the same conditions on the assumption that something is wrong (S33→S31). Here, if the S1, S2, and S3 do not satisfy the above relation for the second time in S33, the process control is terminated and an image is formed at the reference density used in the preceding process control. In other words, the developing bias voltage is maintained under the conditions of the preceding process control. Alternatively, the image forming apparatus may stop the image forming operation upon notification of the inadequate process control.

Note that the toner density sensor 16 outputs a higher output voltage as an amount of reflected light increases, so that it detects the darker state in case of color toners. Therefore, as shown in FIG. 11, the higher the outputs S1 through S3 from the toner density sensor 16, the darker the detected state.

Thus, the density detection by the toner density sensor 16 satisfies the normal relation, namely, S1<S2<S3, whether S1≦STD≦S3 or not is judged (S32*a*). As previously mentioned, STD is the reference value of the density of the test patch image, and a voltage on which the test patch image finally has the density of the reference value is determined as the developing bias voltage V1. If S1≦STD≦S3 is established, a new developing bias voltage value V1 is determined in the following procedure (S34), and the determined developing bias voltage V1 is stored (S35).

The procedure for determining the developing bias voltage V1 will be explained. As has been explained with reference to FIG. 11, the three points of the density of each test patch image, S1, S2, and S3, are plotted, and a straight line S=a·DVB+b is found for each point through the linear approximation. More specifically, coefficients a and b such that almost satisfy, $$S1=a\cdot DVB1+b(DVB1=-450V)$$

$$S2=a\cdot DVB2+b(DVB2=-400V)$$

$$S3=a\cdot DVB3+b(DVB3=-350V).$$

are computed through the linear approximation, and the developing bias voltage V1 such that satisfies STD=a·V1+b is found.

If S1≦STD≦S3 is not established as the result of the density detection of the test patch images, whether the developing bias voltage has reached the upper or lower limit or not is judged (S36). If a correction value exceeding the upper or lower limit is given to the reference value of the developing bias voltage, as previously explained, there occur inconveniences, such as the unwanted adhesion of the carrier to the photosensitive body 1 or the fogging, thereby making the precise density control impossible. Thus, when the developing bias value for one particular color exceeds the upper or lower limit, the developing bias values of the other three colors are set in accordance with the upper or lower limit of that particular color to well balance the colors (S37).

The reason why S37 is carried out is because if any color out of the three colors has too high or low density, an image with unnatural color tone is formed unless the densities of the other colors are adjusted to the density of that particular color. Thus, when the developing bias voltage for one particular color exceeds the upper or lower limit, the correction is made up to its limit for that particular color, and the correction values for the other colors are determined in accordance with a ratio of the actual corrected amount to the necessary corrected amount of that particular color. Consequently, the amount of correction for each color becomes equal, thereby preventing the loss of the color balance.

If the developing bias voltage has not reached the upper or lower limit, whether STD≦S1 or not is judged (S38). If the detected density S1 of the test patch image formed in the lowest density is denser than the reference density STD (STD<S1), 100V is subtracted from the standard developing bias voltage (−400V) to reset the reference bias voltage to −500V (S39*a*). In contrast, if the detected density S1 is lower (lighter) than the reference density STD, 100V is added to the standard developing bias voltage (−400) to reset the reference bias voltage to −300V (S39*b*).

The reference bias voltage is changed in the above manner, and the test patch image of each color is formed again in S30, which is developed on the changed developing bias voltage to detect the density thereof. The rest of the operation is carried out in the same manner as described above.

As has been explained, the developing bias voltage V1 for each of the color toner developing units 4*a* through 4*c* is determined and stored. The following image forming operation is carried out based on the developing bias voltages V1 thus determined, that is, the values stored in S35.

Then, after the developing bias voltages for the color toners are set, the setting control of the developing bias voltage by the process control 2 is carried out. The process control 2 is carried out for the black toner. In case of the black toner, the developed test patch image is transferred onto the reflection area (white portion) 20 on the transfer drum 5, and the density is detected based on an amount of reflected light from the white portion. For this reason, the output value from the toner density sensor 16 is opposite to the one shown in FIG. 11. More specifically, when the density of the test patch image is high, an amount of reflected light from the reflection area decreases, and hence the output value decreases, while the density of the test patch image is low, the output value increases.

Thus, as shown in FIG. 4, the control similar to the one detailed in FIG. 3 is carried out. That is, the control procedure is carried out in the same manner except that the relation is reversed in S42, S42*a* and S48, because, as previously mentioned, the output from the toner density sensor 16 is opposite to the one in case of the color toners. Since the color balance correction is not necessary for the black color, S37 of FIG. 3 is omitted herein, and when the developing bias voltage exceeds the upper or lower limit, the upper or lower limit of the developing bias voltage is set and stored in S45.

(Changing Control Procedure by Toner Mixing Ratio Correcting Means)

Finally, the changing control procedure of the reference of the toner mixing ratio after the control of the developing bias voltage of the developing unit based on the density detection of the above process control in the present example, that is, the density detection of the test patch image, will be explained with reference to FIG. 5. In the present example, the CPU 6 operates as toner mixing ratio correcting means.

Figure 5:
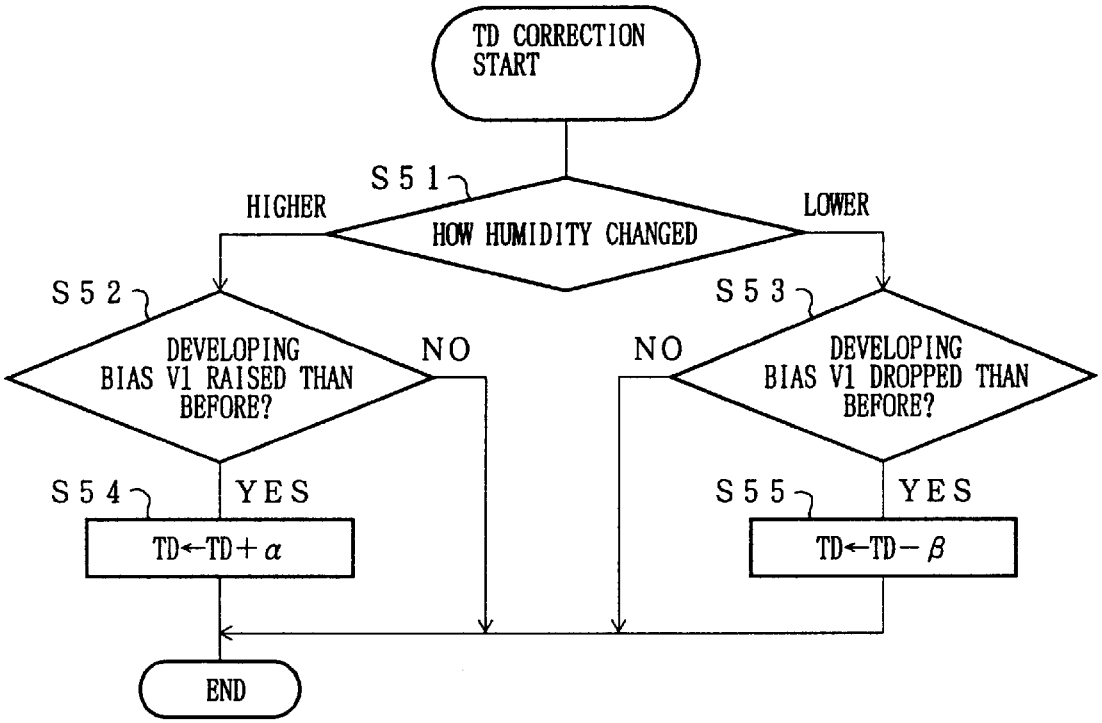
FIG. 5 is a flowchart detailing a changing correction control of a toner mixing ratio of a developing agent in the above image quality compensation control.
Figure 6:
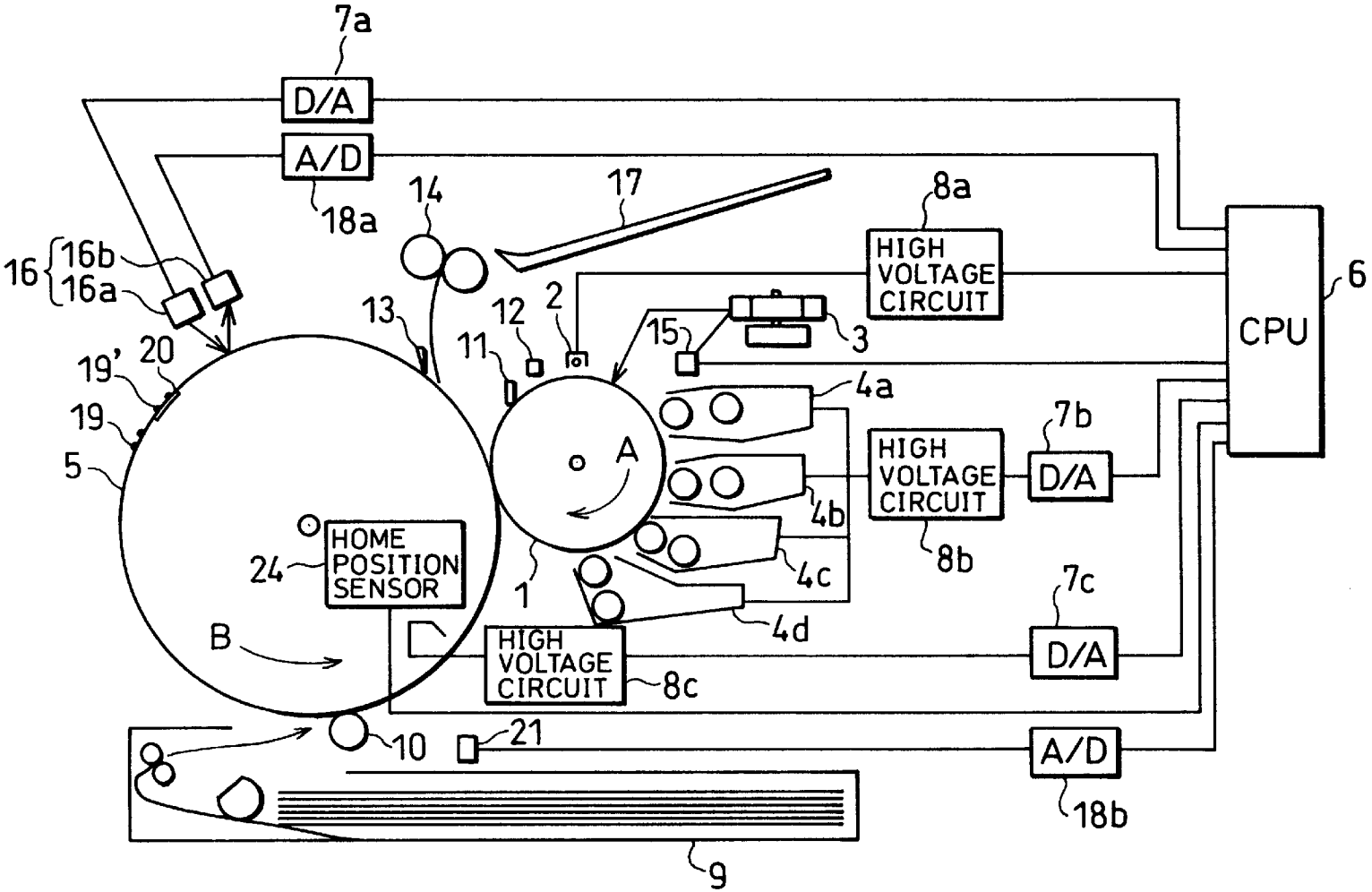
FIG. 6 is a view showing an arrangement of an entire image forming apparatus carrying out the above image quality compensation control.

In FIG. 5, whether the humidity drops or rises is judged (S51). This is done by comparing the current humidity with the humidity detected when the reference of the toner mixing ratio is set as set forth in Table 1 above. The humidity detected when the reference of the toner mixing ratio is set is stored in advance, and this humidity is stored in the form of the areas divided as shown in Table 1 above. It is then confirmed to which area in Table 1 above the humidity detected by the humidity sensor 21 when the process control is carried out belongs. Accordingly, whether the detected humidity area is shifted with respect to the area stored in the preceding process control or not is judged in S51. Here, if the detected humidity area is shifted in an increasing direction from the area stored in the preceding process control, S52 is carried out. On the other hand, when the detected humidity area is shifted in a decreasing direction, S53 is carried out.

In the control in S52, if the test patch image formed in the current process control is denser than the one formed in the preceding process control, the developing bias voltage is corrected in an increasing direction. Thus, when the developing bias voltage V1 needs to be raised, the toner mixing ratio is raised. In other words, a ratio of the toner in the developing agent is dropped.

Here, as shown in S54, a value obtained by adding a correction amount $\alpha$ to the reference toner mixing ratio TD in the preceding process control is stored as a new reference toner mixing ratio TD. The correction amount $\alpha$ is added because the magnetic permeability of the developing agent rises as the toner ratio drops, and the output from the magnetic permeability sensor becomes higher. Therefore, a new toner mixing ratio TD is set by adding the correction amount $\alpha$.

It should be noted, however, if the developing bias voltage is maintained at the same level or corrected in a decreasing direction when the developing bias voltage is corrected based on the density detection of the test patch image by the process control, the toner mixing ratio is not corrected and maintained at the same level as the level in the preceding process control.

If the test patch image formed during the current process control is denser (the density is higher) than the one formed in the preceding process control in S53, the toner mixing ratio is maintained at the same level.

If the density of the test patch image formed during the current process control is lower than the density of the one formed in the preceding process control, the toner mixing ratio is raised (S55). In other words, when the density drops, the correction control is carried out to drop the developing bias voltage V1 to raise the density. Here, to lower the toner mixing ratio, a correction amount $\beta$ is subtracted from the reference toner mixing ratio (the reference toner mixing ratio in the preceding process control) TD, which is set as a new reference toner mixing ratio TD.

As has been explained, the output from the magnetic permeability sensor drops as the toner ratio of the developing agent in the developing unit rises. Thus, to raise the toner mixing ratio from the one used in the preceding process control, the reference mixing ratio (mixing ratio reference voltage) TD is dropped by the correction amount $\beta$.

As has been explained, in the present example, the correction control of the toner mixing ratio of the developing agent in the developing unit is carried out in addition to the process control, that is, while the density detection using the test patch image is carried out, and the control of the process condition (herein, the developing bias voltage control) is carried out based on the detection result. Here, as shown in FIG. 5, if the developing bias voltage does not change from the one in the preceding process control, the toner mixing ratio is not corrected regardless of the humidity detection result by the humidity sensor. The toner mixing ratio of the developing agent is corrected only if the developing bias voltage has changed from the one in the preceding process control, especially, when a change of the humidity state is confirmed by the humidity sensor.

As has been explained, when the changing correction of the toner mixing ratio is carried out, the process control is carried out again after the corrected and changed toner mixing ratio is set as the new reference toner mixing ratio TD. This is done to compensate the image quality not to change due to the change of the density caused by the change of the toner mixing ratio. Thus, the developing bias voltage, which is one of the image forming conditions, is controlled in accordance with the control procedure of FIG. 3 or 4 by the compensation control means.

Thus, unlike the conventional image forming apparatus, in the image forming apparatus of the present example, since the toner mixing ratio is neither corrected nor changed in response to the change in humidity alone, the toner mixing ratio is never changed inadequately. Consequently, it has become possible to keep forming images in a stable image quality state on the developing bias voltage set by the process control.

The flow proceeds to the routine of FIG. 5 only if the humidity when the process control is carried out changes (different area) from the humidity (any of areas 1–4) stored when the reference toner mixing ratio TD is set in S15 of FIG. 1. Thus, when the humidity has not changed, the routine in FIG. 5 is not carried out, and the toner mixing ratio is maintained at the reference value set in the preceding process control.

In the present example, the developing bias voltage DVB is set to a negative value, which is raised or dropped. This means that the developing bias voltage is raised (increases) or dropped (decreased) with respect to the absolute value. Also, in the above example, the developing bias voltage is corrected and controlled based on the result of the process control. However, the present embodiment is not limited to the above disclosure, and the other image forming conditions, such as a known control of the charged potential of the photosensitive body, may be controlled to adjust the density.

Unlike the printer of the present example, in a copying machine for forming an image of light directly on the photosensitive body 1 by irradiating light to an original image, the image density can be corrected by controlling an amount of exposure when irradiating light to the original image. In this case, an amount of exposure may be corrected and controlled.

As has been explained, an image forming apparatus of the present invention is an image forming apparatus for reproducing an image by forming a latent image of the image on a recording medium, converting the latent image into a developed image with a developing agent including toner to visualize the latent image, and transferring the developed image onto a sheet, comprising:

image quality compensating means for, apart from an image forming operation for reproducing the image, forming a test patch image at a predetermined density on the recording medium to detect a density thereof, and subsequently for controlling at least one of image forming conditions based on a detection result to form an image while maintaining an image quality state of the image at a constant level;

an environment detecting sensor for detecting an operating environment inside the image forming apparatus; and toner mixing ratio correcting means for, when the image quality compensating means detects the density of the test patch image, determining whether a toner mixing ratio of the developing agent should be changed or not in response to an environment detection state from the environment detecting sensor.

According to the above-arranged image forming apparatus, the toner mixing ratio is not changed in response to the environmental change alone, such as the change in humidity, and therefore, the image quality compensation is carried out in response to the forming state of the test patch image.

In the above image forming apparatus, it is preferable that the environments detecting sensor is a humidity sensor for detecting relative humidity, and the image quality compensating means controls the developing bias voltage in response to the detected density of the test patch image.

Also, it is preferable that the toner mixing ratio correcting means changes the toner mixing ratio only if the humidity sensor detects the change in humidity when the developing bias voltage is corrected in a direction such that changes a condition used in a preceding control.

Consequently, it has become possible to always form an image at a normal density, and hence to compensate the image quality in a stable manner.

More specifically, the toner mixing ratio changing means changes and corrects the toner mixing ratio only when the image quality compensating means corrects the developing bias voltage in a direction to either rise or drop, while the humidity sensor detects that the humidity has been shifted in a direction to rise or drop; otherwise, the toner mixing ratio changing means does not change the toner mixing ratio. Thus, the toner mixing ratio is not changed in response to the change in humidity alone.

For example, if the image forming apparatus is placed under a high temperature/high humidity circumstance, the toner mixing ratio is conventionally controlled to rise because the amount of charge in the toner decreases. To solve this problem, when the humidity sensor detects the high humidity, the mixing ratio is conventionally controlled to drop.

Also, if the image forming apparatus is placed under a low temperature/low humidity circumstance, the toner mixing ratio is conventionally controlled to drop because the amount of charge in the toner increases. To solve this problem, when the humidity sensor detects the low humidity, the mixing ratio is conventionally controlled to rise.

In case of the conventional control, if the image forming apparatus is placed in the low temperature/high humidity circumstance, the amount of charge in the toner does not decrease much, but the humidity sensor detects the high humidity and the toner mixing ratio is controlled to drop, thereby making it impossible to maintain the normal image quality compensation. Also, if the image forming apparatus is placed in the high temperature/low humidity circumstance, the amount of charge in the toner does not increase much either, but the humidity sensor detects the low humidity, and the toner mixing ratio is controlled to rise, thereby making it impossible to maintain the normal image quality compensation, either.

However, in the arrangement of the present embodiment, whether the image forming apparatus is in the high temperature or low temperature circumstance can be learned by detecting the tendency of the change of the density of the test patch image. That is, when the humidity is in a predetermined range, the image compensation control is carried out and a toner mixing ratio is set in a normal manner.

In other words, the test patch image is formed under the predetermined conditions, and the density thereof is detected, so that the developing bias voltage value is controlled based on the difference between the detected density value and the predetermined reference value. When the humidity sensor detects high humidity, the toner mixing ratio is controlled to drop if the density of the test patch image is higher than the one used in the preceding process control, that is, if the developing bias voltage has risen, while the developing bias voltage value is controlled. Then, the image quality stabilizing control is carried out again after a predetermined period. This is done to judge whether the corresponding developing bias voltage is normal or not when the toner mixing ratio is changed, and also to maintain the image quality at a constant level by forming the test patch image.

In this case, if the density of the test patch image is lower than the one used in the preceding process control, the toner mixing ratio is not changed nor controlled even if the humidity sensor detects higher humidity.

On the contrary, when the humidity sensor detects lower humidity, the toner mixing ratio is controlled to rise when the density of the test patch image is lower than the density of the one used in the preceding process control. Then, the test patch image is formed again after a predetermined period, and the developing bias voltage is corrected and controlled in accordance with the changed toner mixing ratio. In this case, the toner mixing ratio is not changed when the density of the test patch image is higher than the one used in the preceding process control.

Therefore, the toner mixing ratio is neither changed nor controlled in response to the output from the humidity sensor alone, and the toner mixing ratio can be controlled in response to the image density only by providing the relative humidity sensor, and as a consequence, the stable image quality compensation can be realized.

An image forming apparatus of the present embodiment may have the following arrangement.

That is, another image forming apparatus of the present embodiment is an image forming apparatus for reproducing an image by forming a latent image of the image on a recording medium, converting the latent image into a developed image with a developing agent including toner to visualize the latent image, and transferring the developed image onto a sheet, comprising:

image quality compensating means for, apart from an image forming operation for reproducing the image, forming a test patch image having a predetermined density on the recording medium to detect a density thereof, and subsequently for controlling at least one of image forming conditions based on a detection result to form an image while maintaining an image quality state of the image at a constant level, wherein, the image quality compensating means detects the density in accordance with a first amount of reflected light from the test patch image and uses the first amount to control one of the image forming conditions, and when the fist amount of reflected light can not be detected, the image quality compensating means forms the test patch image on a reflection area with a good reflection condition to detect a second amount of reflected light from the reflection area and uses the second amount to control one of the image forming conditions, and the image quality compensating means controls a unit area amount of toner particles adhering to the test patch image formed on the reflection area becomes small, so that the second amount of the reflected light from the reflection area and the first amount of reflected light from the test patch image of any other color are equal.

The image quality compensating means is arranged to carry out the control operation of the image forming conditions at least when the power source of the image forming apparatus is turned ON, the developing agent is replaced, environmental conditions are changed, or a predetermined number of images are formed.

Further, the image forming apparatus is arranged to include developing devices of different colors, and the image quality compensating means is arranged to transfer the test patch image from the recording medium to the transfer medium under the conditions different from those for the image forming operation or under the conditions for respective colors.

The image forming apparatus is arranged to include developing devices of different colors, and the image quality compensating means is arranged to control the developing bias voltage under the image forming conditions. When the developing bias voltage for a particular color exceeds the upper or lower limit, the image quality compensating means corrects the developing bias voltage up to the upper or lower limit, and the developing bias voltages of the other colors are set using the developing bias voltage of this particular color corrected in the above manner as the reference.

Accordingly, the test patch images formed by the image quality compensating means are not always the same, and changed depending on the color being used, so that the density is detected precisely for the test patch image of each color. When the test patch image is transferred onto the transfer medium or the like, the density of the test patch image of each color can be detected accurately by changing the transfer conditions for the color being used. Since the test patch image is transferred onto the transfer medium under the same conditions when an image is transferred onto a sheet, the density can be detected under the same conditions when the image is transferred onto a sheet, thereby realizing highly accurate image quality compensation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus for reproducing an image by (a) forming a latent image of said image on a recording medium, (b) converting said latent image into a developed image with a developing agent including toner particles and carrier particles so as to visualize said latent image, and (c transferring said developed image onto a sheet; said apparatus comprising:

means for forming a test patch image apart from the reproduction of said image, said test patch image having a predetermined density;

density detecting means for detecting the density of said test patch image as a reference density value for maintaining a constant level of image quality state of said image to be formed by said image forming apparatus;

image quality compensation means for, on controlling at least one image forming condition based on a detection result from said density detecting means;

a humidity sensor for detecting relative humidity inside said image forming apparatus; and toner mixing ratio correcting means for, when said density detecting means detects said reference density value, determining whether a toner mixing ratio of said developing agent should be changed or not in response to a state of said at least one image forming condition controlled by said image quality compensation means, and in response to the relative humidity detected by said humidity sensor.

2. The image forming apparatus of claim 1, wherein:

said image quality compensation means controls a developing bias voltage in response to said reference density value;

said toner mixing ratio correcting means changes the percentage of said toner particles in said developer agent only when said humidity sensor detects a change in humidity; and, said image quality compensating means changes said developing bias voltage before and after controlling said at least one image forming condition.

3. The image forming apparatus of claim 2, wherein:

said toner mixing ratio correcting means (i) corrects the percentage of said toner particles in said developer agent when the direction of a change in the developing bias voltage caused by said image quality compensating means and the direction of a shift in the output of said humidity sensor are the same, and (ii) leaves the percentage of toner particles in said developer agent intact when said correction direction and said shift direction are not the same.

4. The image forming apparatus of claim 1 further comprising at least one replaceable developing device, and wherein said image quality compensation means carries out a control operation image forming condition at least:

(a) when a power source of said image forming apparatus is turned ON, (b) when said developing agent is replaced, (c) when at least one of said at least one replaceable developing device is replaced, (d) when the relative humidity sensed by said humidity sensor has changed, and/or (e) when an image forming operation is repeated for a predetermined number of sheets.

5. The image forming apparatus of claim 1 further comprising developing units for more than one color, wherein:

said image quality compensating means transfers said test patch image from said recording medium to a transfer medium under one of the following two conditions:

(1) a condition different from a condition of the image forming operation and (2) a condition changed depending on a color being used.

6. The image forming apparatus of claim 5, wherein:

said developing units include developing units for colors and a developing unit for black; and the test patch image for black toner is transferred onto a high reflection area provided on said transfer medium.

7. The image forming apparatus of claim 1 further comprising developing units for more than one color, wherein:

said image quality compensating means controls a developing bias voltage within a predetermined range, and if the developing bias voltage of one particular color exceeds one of an upper limit and a lower limit of said range, said particular color is corrected to one of the upper limit and lower limit, while the developing bias voltages for other colors are set based on the developing bias voltage of said particular color.

8. An image forming apparatus for reproducing an image by (a) forming a latent image of said image on a recording medium, (b) converting said latent image into a developed image with a developing agent including toner particles and carrier particles so as to visualize said latent image, and (c) transferring said developed image onto a sheet; said apparatus comprising:

image quality compensation means for, apart from reproducing said image, (i) forming a test patch image having a predetermined density on said recording medium, (ii) detecting the density of said test patch image, and (iii) subsequently, controlling at least one image forming condition based on the detected test patch image density while maintaining an image quality state of said image at a constant level;

wherein, said image quality compensating means detects the density in accordance with a first amount of reflected light from said test patch image and uses said first amount of reflected light to control at least one image forming condition; and, when said first amount of light can not be detected, said image quality compensation means forms said test patch image on a reflective area with a good reflection condition to detect a second amount of reflected light from said reflection area and uses said second amount of reflected light to control at least one image forming condition, and said image quality compensation means controls the quantity of toner particles adhering to the test patch image formed on a unit area of said reflection area so that said quantity is small, and so that said second amount of the reflected light from said reflection area and said first amount of reflected light from the test patch image of any other color are equal.

9. The image forming apparatus of claim 1 further comprising developing units for more than one color, wherein:

said image quality compensating means transfers said test patch image from said recording medium to a transfer medium under one of the following two conditions:

(1) a condition different from a condition of the image forming operation and (2) a condition changed depending on a color being used.

10. The image forming apparatus of claim 8 further comprising developing units for more than one color, wherein:

said image quality compensating means controls a developing bias voltage within a predetermined range, and if the developing bias voltage of one particular color exceeds one of an upper limit and a lower limit of said range, said particular color is corrected to one of the upper limit and lower limit, while the developing bias voltages for other colors are set based on the developing bias voltage of said particular color.

* * * * *